US009171514B2

(12) United States Patent
Kim et al.

(10) Patent No.: US 9,171,514 B2
(45) Date of Patent: Oct. 27, 2015

(54) SOURCE DRIVER, METHOD THEREOF, AND APPARATUSES HAVING THE SAME

(71) Applicant: Samsung Electronics Co., Ltd, Suwon-si, Gyeonggi-do (KR)

(72) Inventors: Yang Wook Kim, Seoul (KR); Suk Yun Woo, Seoul (KR); Jun Ho Song, Seoul (KR); Seong Jong Yoo, Seongnam-si (KR); Dong Min Lee, Incheon (KR); Kyung Gyu Park, Seoul (KR); Hyung Woo Yu, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 60 days.

(21) Appl. No.: 14/015,166

(22) Filed: Aug. 30, 2013

(65) Prior Publication Data

US 2014/0062995 A1 Mar. 6, 2014

(30) Foreign Application Priority Data

Sep. 3, 2012 (KR) ..... 10-2012-0096905
Sep. 5, 2012 (KR) ..... 10-2012-0098490

(51) Int. Cl.
*G09G 3/36* (2006.01)

(52) U.S. Cl.
CPC ..... *G09G 3/3674* (2013.01); *G09G 3/3688* (2013.01); *G09G 3/3614* (2013.01); *G09G 2310/0294* (2013.01); *G09G 2310/0297* (2013.01)

(58) Field of Classification Search
CPC ..... G09G 3/3688; G09G 3/3614; G09G 2310/0294; G09G 2310/0297; G09G 2310/0286
USPC ..... 345/76, 96, 98, 99, 100, 204, 214
See application file for complete search history.

(56) References Cited

U.S. PATENT DOCUMENTS

| | | | | |
|---|---|---|---|---|
| 6,388,653 | B1 * | 5/2002 | Goto et al. | 345/98 |
| 6,621,478 | B1 * | 9/2003 | Sakaguchi et al. | 345/98 |
| 6,784,866 | B2 | 8/2004 | Udo et al. | |
| 7,696,970 | B2 | 4/2010 | Yokota | |
| 8,068,080 | B2 | 11/2011 | Nishimura | |
| 2003/0071779 | A1 * | 4/2003 | Lee et al. | 345/99 |
| 2003/0090451 | A1 * | 5/2003 | Ahn | 345/96 |
| 2003/0151584 | A1 * | 8/2003 | Song et al. | 345/100 |
| 2004/0189572 | A1 * | 9/2004 | Nose | 345/92 |
| 2005/0200587 | A1 * | 9/2005 | Hwang | 345/96 |
| 2005/0253833 | A1 * | 11/2005 | Teshirogi et al. | 345/204 |
| 2006/0077738 | A1 * | 4/2006 | Kwon | 365/203 |
| 2006/0192699 | A1 * | 8/2006 | Azami et al. | 341/100 |

(Continued)

FOREIGN PATENT DOCUMENTS

| | | |
|---|---|---|
| JP | 4407903 | 7/2004 |
| JP | 2008-292927 | 12/2008 |

(Continued)

*Primary Examiner* — Premal Patel
(74) *Attorney, Agent, or Firm* — Ellsworth IP Group PLLC

(57) ABSTRACT

A method of muxing data by using clock signals having different timings and an apparatus performing the method are provided. Storing and muxing (or dividing) the data are simultaneously performed. The apparatus includes a first latch circuit arranging data blocks, which are input in series, in parallel in response to non-overlapping latch control signals and a second latch circuit latching the data blocks arranged in parallel simultaneously in response to a clock signal.

10 Claims, 33 Drawing Sheets

(56) References Cited

U.S. PATENT DOCUMENTS

| | | | | |
|---|---|---|---|---|
| 2006/0208997 | A1* | 9/2006 | Sunohara et al. | 345/100 |
| 2007/0103389 | A1* | 5/2007 | Shin | 345/36 |
| 2007/0262941 | A1* | 11/2007 | Jan et al. | 345/96 |
| 2007/0279341 | A1* | 12/2007 | Park | 345/77 |
| 2008/0068360 | A1* | 3/2008 | Fukuo | 345/204 |
| 2008/0122810 | A1* | 5/2008 | Murase et al. | 345/204 |
| 2008/0158131 | A1 | 7/2008 | Park et al. | |
| 2009/0040149 | A1* | 2/2009 | Nishinohara | 345/76 |
| 2009/0058838 | A1* | 3/2009 | Lee et al. | 345/204 |
| 2009/0262146 | A1 | 10/2009 | Hashimoto | |
| 2011/0032245 | A1 | 2/2011 | Inokuchi | |
| 2011/0148842 | A1 | 6/2011 | Nakayama | |
| 2011/0216052 | A1 | 9/2011 | Tanaka | |

FOREIGN PATENT DOCUMENTS

| | | |
|---|---|---|
| JP | 2009-109884 | 5/2009 |
| KR | 10-0469349 | 1/2005 |
| KR | 10-0686873 | 2/2007 |

* cited by examiner

SOURCE DRIVER, METHOD THEREOF, AND APPARATUSES HAVING THE SAME

CROSS-REFERENCE TO RELATED APPLICATIONS

This application claims from the benefit of priority under 35 U.S.C. §119 from Korean Patent Application No. 10-2012-0096905 filed on Sep. 3, 2012 and Korean Patent Application No. 10-2012-0098490 filed on Sep. 5, 2012, in the Korean Intellectual Property Office, the disclosures of which are incorporated herein by reference in their entirety.

BACKGROUND

1. Field

Embodiments of the present general inventive concept relate to a source driver, and more particularly, to a source driver capable of muxing data by using clock signals each having a different timing, an operation method thereof, and apparatuses having the same. Embodiments of the present general inventive concept also relate to a display device, and more particularly, to a source driver which may use a plurality of dot inversion modes, and a display device having the same.

2. Description of the Related Art

A source driver or a data line driver converts a digital signal corresponding to image data to display into an analog signal and provides a converted analog signal to a pixel of a display panel so that the image data may be displayed.

To prevent performance deterioration of a liquid crystal display (LCD), e.g., a crosstalk phenomenon or a flicker, a general source driver inverts polarity of an analog signal supplied to a pixel in every frame. This is called polarity inversion driving.

The polarity inversion driving modes includes a frame inversion mode, a column inversion mode, a line inversion mode and a dot inversion mode.

In the frame inversion mode, polarity of analog signals supplied to pixels in one frame is all the same. In the column inversion mode, polarity of analog signals supplied to adjacent pixels in a column is different from each other. In the line inversion mode, polarity of analog signals supplied to adjacent pixels in a line is different from each other.

The dot inversion mode includes a one-DOT inversion mode, where polarity of analog signals supplied to adjacent pixels is different from each other, and an n-DOT inversion mode, where polarity of analog signals supplied to n adjacent pixels, where n is a natural number greater than one, is the same as each other and polarity of analog signals supplied to the n pixels is different from polarity of analog signals supplied to pixels adjacent to the n pixels.

Among the polarity inversion driving modes, there is least crosstalk phenomenon in the dot inversion mode. It is therefore widely used in large-sized displays and mobile displays.

A source driver may include a digital-to-analog conversion circuit, which includes a P-type decoder (or a P-type digital-to-analog converter) and an N-type decoder (or an N-type digital-to-analog converter) to embody the dot inversion mode.

To reduce the complexity of a circuit and the size of a chip in a conventional source driver, adjacent channels may share a digital-to-analog conversion circuit. To be more concrete, the conventional source driver may be improved to reduce the complexity of a digital-to-analog conversion circuit and the size of a chip by exchanging a digital signal, i.e., data, between adjacent channels in response to a polarity control signal, converting each of the exchanged data into analog signals, and exchanging analog signals with each other again.

Further improvements to the conventional source driver could include additional multiplexers to operate in different dot inversion modes. The complexity of the source driver and the size of a chip, however, may increase in proportion to the number of the multiplexers.

SUMMARY

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a source driver, including a first latch circuit configured to arrange in parallel data blocks, which are input in series, in response to non-overlapping latch control signals, and a second latch circuit configured to latch data blocks which are arranged in parallel simultaneously in response to a clock signal. The source driver may further include a latch control circuit configured to generate the non-overlapping latch control signals successively in response to a selection signal.

The latch control circuit includes a plurality of multiplexers each configured to output one of a plurality of latch clock signals as one of the plurality of latch control signals in response to the selection signal.

Each of the plurality of multiplexers alternately outputs the plurality of latch clock signals as the one latch control signal.

The source driver further includes a control circuit configured to generate the selection signal based on a polarity control signal and an inversion mode control signal.

The source driver includes a digital-to-analog conversion circuit configured to convert output signals of the second latch circuit into analog signals, a multiplexing circuit configured to rearrange the analog signals in response to the selection signal, and an output buffer circuit configured to buffer and output rearranged analog signals.

The foregoing and/or other features and utilities of the present general inventive concept may also be achieved by providing a display device, including the source driver and a display panel which displays output signals of the source driver in response to a gating signal output from a gate driver.

The foregoing and/or other features and utilities of the present general inventive concept may also be achieved by providing a method of processing data, including arranging in parallel data blocks, which are input in series, in response to non-overlapping latch control signals, and latching data blocks arranged in parallel simultaneously in response to a clock signal.

The method further includes generating the non-overlapping latch control signals successively in response to a selection signal.

The generating successively the latch control signals includes outputting a plurality of latch clock signals alternately as one of the latch control signals in response to the selection signal.

The foregoing and/or other features and utilities of the present general inventive concept may also be achieved by providing a source driver, including a plurality of first type decoders, a plurality of second type decoders each forming a symmetric pair with each of the plurality of first type decoders, a plurality of multiplexers each configured to respectively output one of either output signals of the decoders forming the symmetric pairs in response to a corresponding one of a plurality of selection signals, and a plurality of buffers each configured to buffer an output signal of a corresponding one of the plurality of multiplexers.

The plurality of first type decoders may be embodied in a first region, and the plurality of second type decoders may be embodied in a second region.

The first region and the second region may be electrically divided. The first region may be an N-type well, and the second region may be a P-type well.

The source driver may further include a control circuit generating the plurality of selection signals in response to a polarity control signal and an inversion mode control signal.

Each of the plurality of first type decoders may be embodied in P-type transistors formed in the N-type well, and each of the plurality of second decoders may be embodied in N-type transistors formed in the P-type well.

Each of the plurality of buffers may be a unit gain buffer, and the unit gain buffer may be a rail-to-rail buffer.

The foregoing and/or other features and utilities of the present general inventive concept may also be achieved by providing a display device, including the source driver and a display panel which displays output signals of the plurality of buffers in response to a gating signal output from a gate driver.

The foregoing and/or other features and utilities of the present general inventive concept may also be achieved by providing a source driver, including decoders including a plurality of first type decoders and a plurality of second type decoders each forming a symmetric pair with each of the plurality of first type decoders, a plurality of buffers each buffering an output signal of a corresponding one of the plurality of decoders, and a plurality of multiplexers each outputting one of output signals of buffers corresponding to the symmetric pair in response to a corresponding one of a plurality of selection signal.

The plurality of first type decoders may be embodied in a first region, the plurality of second type decoders may be embodied in a second region, and the first region and the second region may be electrically divided.

The first region may be an N-type well, and the second region may be a P-type well.

The source driver may further include a control circuit generating the plurality of selection signals in response to a polarity control signal and an inversion mode control signal.

Each of the plurality of first type decoders may be embodied in P-type transistors formed in the N-type well, and each of the plurality of second type decoders may be embodied in N-type transistors formed in the P-type well.

The foregoing and/or other features and utilities of the present general inventive concept may also be achieved by providing a display device, including the source driver and a display panel which displays output signals of the plurality of multiplexers in response to a gating signal output from a gate driver.

The foregoing and/or other features and utilities of the present general inventive concept may also be achieved by providing a method of operating a source driver, comprising latching data input in series by using a plurality of control signals having different timings, transmitting the latched data simultaneously in parallel according to a clock signal, and rearranging and outputting the transmitted data according to an inversion mode.

Transmitting the latched data may further comprise converting the transmitted data to analog using a plurality of a first type decoder and a plurality of a second type decoder.

Rearranging and outputting the transmitted data may further comprise generating a plurality of switching signals in response to a polarity control signal and an inversion mode control signal, and outputting one of output signals of a first type decoder and a second type decoder forming a symmetric pair in response to a corresponding one of the plurality of switching signals.

The foregoing and/or other features and utilities of the present general inventive concept may also be achieved by providing an electronic apparatus, comprising, an interface configured to receive image data, and output a plurality of control signals, a clock signal and data blocks, a source driver having a first latch circuit configured to arrange the data blocks from the interface, which are input in series, in parallel in response to non-overlapping latch control signals, and a second latch circuit configured to latch the data blocks arranged in parallel simultaneously in response to the clock signal, and configured to generate latch control signals and output display signals in response to the control signals from the interface, a gate driver to output gating signals in response to the control signals from the interface, and, a display panel to display an image in response to the display signals from the source driver and the gating signals from the gate driver.

The source driver may further comprise a digital-to-analog conversion circuit configured to convert output signals from the second latch circuit into analog signals.

The source driver may further comprise a multiplexer circuit configured to rearrange and output the analog signals to the display panel in response to at least one selection signal.

The source driver may further comprise a control circuit configured to generate the at least one selection signal based on a polarity control signal and an inversion mode control signal from the interface.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
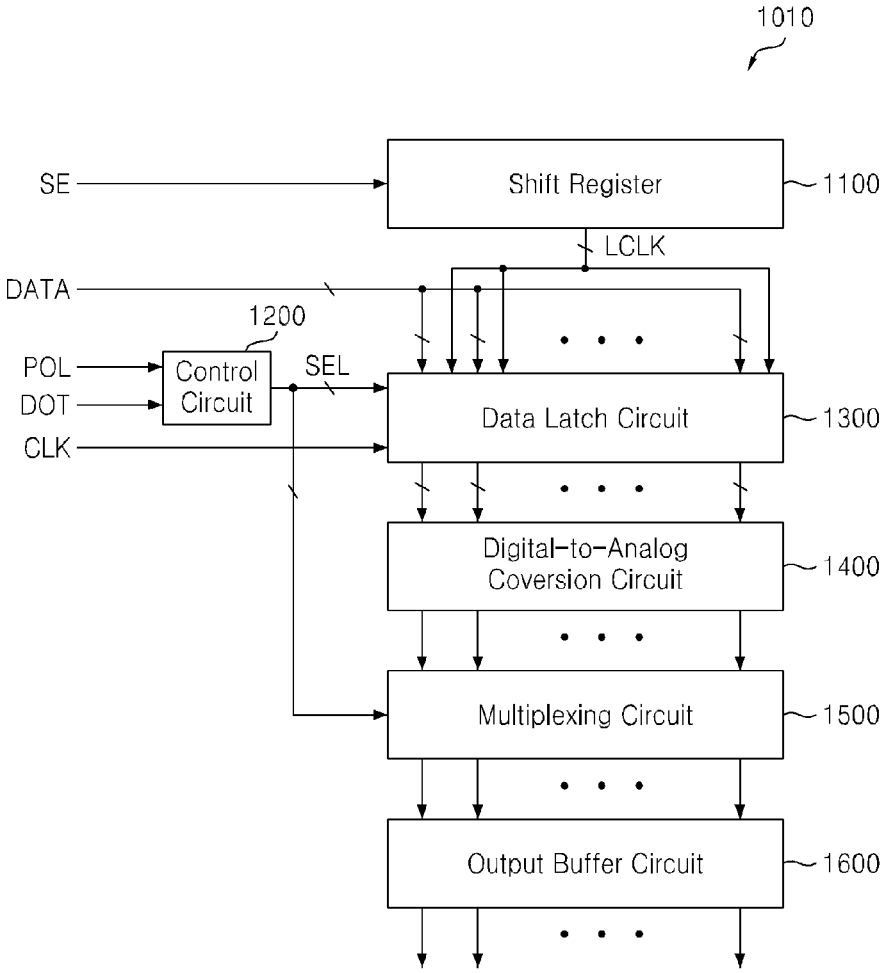
FIG. 1 is a schematic block diagram of a source driver according to an exemplary embodiment of the present general inventive concept.

An exemplary embodiment of the present general inventive concept, i.e., a method of muxing input data by using clock signals having different timings or phases, may be used in various data processing devices or a data processing circuit. For convenience of explanation in the present general inventive concept, a source driver is explained as an example of a data processing device; however, the present general inventive concept is not restricted thereto.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

FIG. 1 is a schematic block diagram of a source driver according to an exemplary embodiment of the present general inventive concept. Referring to FIG. 1, a data processing device, e.g., a source driver 1010, includes a shift register 1100, a control circuit 1200, a data latch circuit 1300, a digital-to-analog conversion circuit 1400, a multiplexing circuit 1500, and an output buffer circuit 1600.

The shift register 1100 may output a plurality of latch clock signals LCLK successively to the data latch circuit 1300 in response to a start signal SE for starting an operation of the source driver 1010. The plurality of latch clock signals LCLK have different timings or phases as non-overlapping signals. Accordingly, the data processing device 1010 may mux input data by using a plurality of latch clock signals LCLK or signals having different timings.

The control circuit 1200 may output at least one selection signal SEL based on a polarity control signal POL and an inversion mode control signal DOT.

The polarity control signal POL may be a signal alternately converted in every frame. For example, when the polarity control signal POL is at a high level in a current frame, the polarity control signal POL may become a low level in a next frame.

The inversion mode control signal DOT is a signal for controlling an inversion mode of a display panel. When the inversion mode control signal DOT indicates an n-DOT inversion mode, where n is a natural number, the control circuit 1200 may generate at least one selection signal SEL so that the source driver 1010 may operate in the n-DOT inversion mode.

For example, when the inversion mode control signal DOT indicates a one-DOT inversion mode, the control circuit 1200 may generate at least one selection signal SEL so that the source driver 1010 may operate in the one-DOT inversion mode, i.e., polarity of analog signals supplied to adjacent pixels is different from each other. For another example, when the inversion mode control signal DOT indicates an n-DOT inversion mode, the control circuit 1200 may generate at least one selection signal SEL so that the source driver 1010 may operate in the n-DOT inversion mode, i.e., polarity of analog signals supplied to adjacent n pixels is identical to each other and polarity of analog signals supplied to the n pixels is different from polarity of analog signals supplied to another n pixels adjacent to the n pixels.

The data latch circuit 1300 arranges in parallel data blocks DATA which are input in series, and latches the data blocks arranged in parallel in response to a plurality of latch clock signals LCLK, a clock signal CLK and at least one selection signal SEL.

Figure 2:
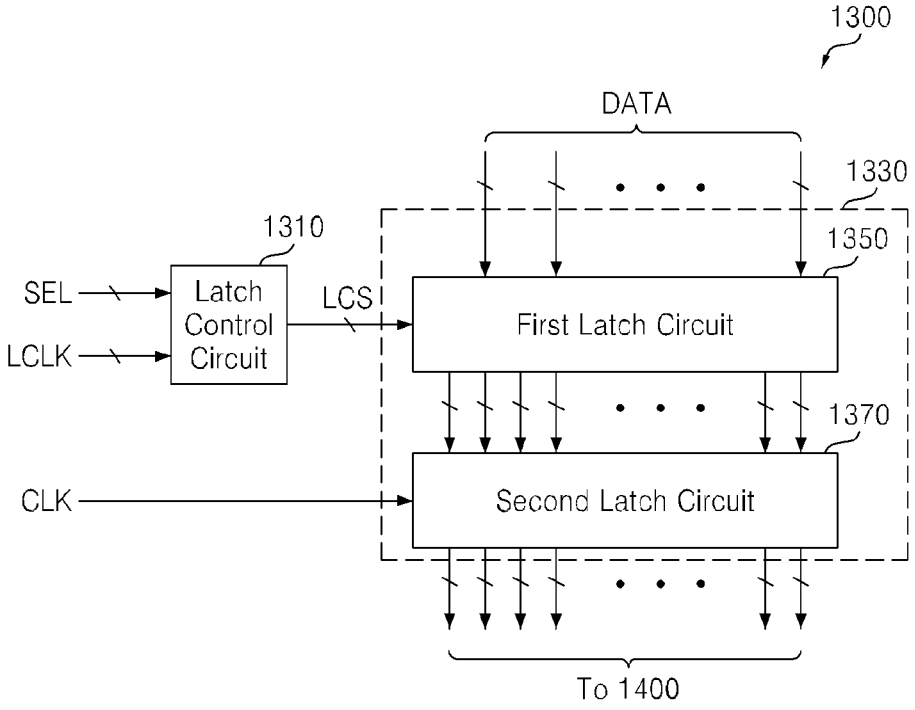
FIG. 2 is a schematic block diagram of a data latch circuit illustrated in FIG. 1.
Figure 3:
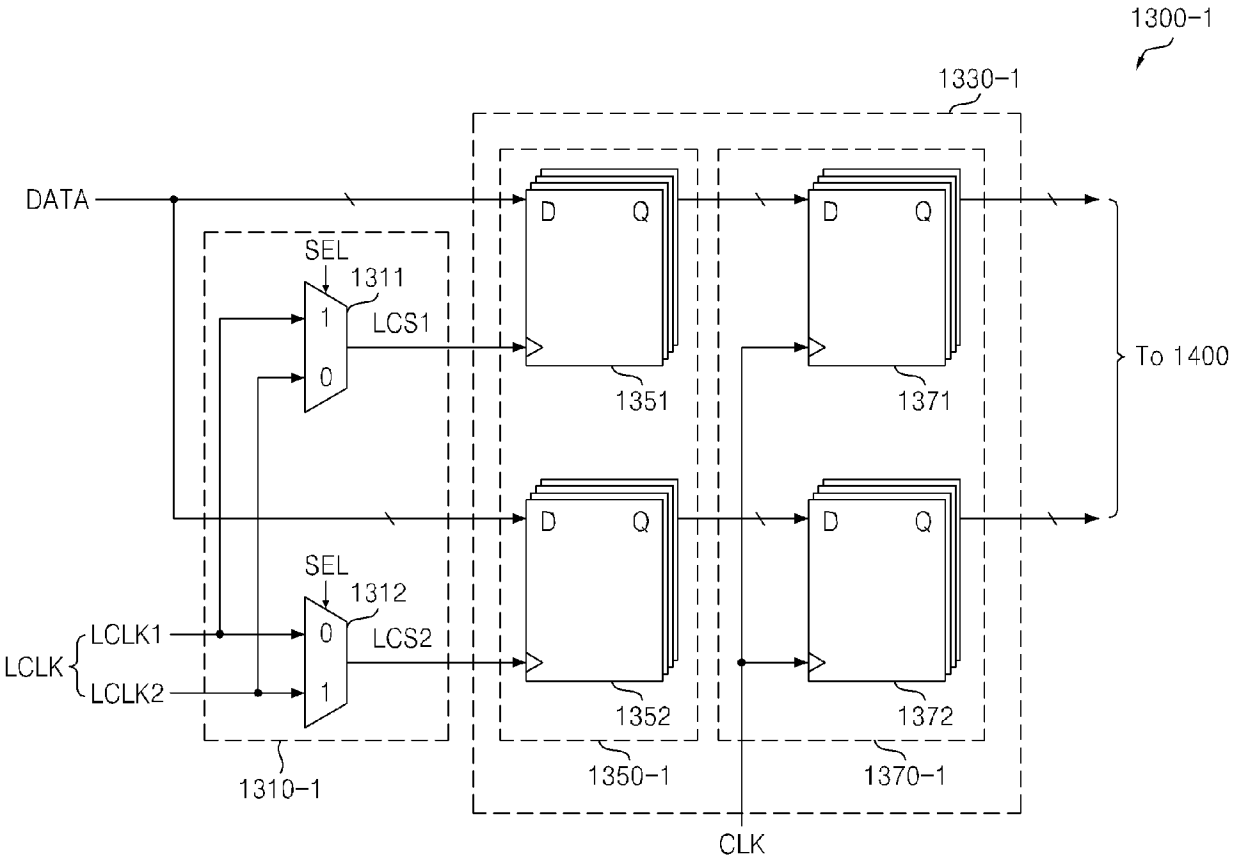
FIG. 3 is a circuit diagram illustrating an exemplary embodiment of the data latch circuit illustrated in FIG. 2.
Figure 4:
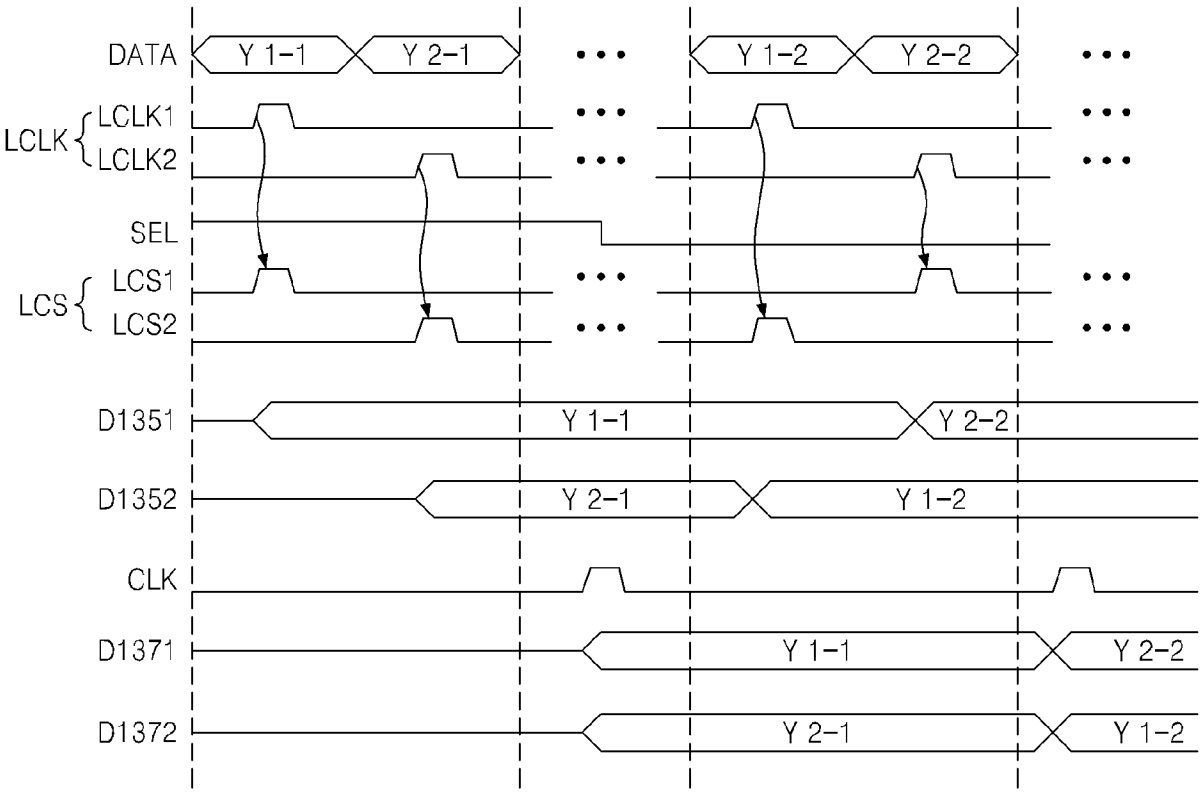
FIG. 4 is a timing diagram illustrating an operation of the data latch circuit illustrated in FIG. 3.

The data latch circuit 1300 may use a plurality of latch clock signals LCLK to generate a plurality of latch control signals LCS (as shown in FIGS. 2 and 4) in response to a selection signal SEL, arrange data blocks DATA, which are input in series, in parallel in response to a plurality of generated latch control signals LCS, and latch the data blocks DATA arranged in parallel simultaneously in response to a clock signal CLK. An operation of the data latch circuit 1300 will be explained in detail referring to FIGS. 2 through 16.

The digital-to-analog conversion circuit 1400 converts output signals of the data latch circuit 1300 into analog signals. According to an exemplary embodiment, the digital-to-analog conversion circuit 1400 may include a plurality of positive digital-to-analog converters (or positive decoders) and a plurality of negative digital-to-analog converters (or negative decoders).

Each of the plurality of positive digital-to-analog converters may convert a corresponding one of output signals of the data latch circuit 1300 into a positive analog signal, and each of the plurality of negative digital-to-analog converters may convert another corresponding one of output signals of the data latch circuit 1300 into a negative analog signal.

For convenience of explanation in the present general inventive concept, polarity of analog signals is referred to as divided into positive and negative. The present general inventive concept, however, is not restricted thereto. That is, 'positive' in the present general inventive concept may mean a voltage higher than a reference voltage, and 'negative' may mean a voltage lower than the reference voltage.

The multiplexing circuit 1500 may rearrange output signals of the digital-to-analog conversion circuit 1400 in response to at least one selection signal SEL. That is, the multiplexing circuit 1500 may rearrange the analog signals so that analog signals may be output to corresponding pixels in response to at least one selection signal SEL.

Figure 32:
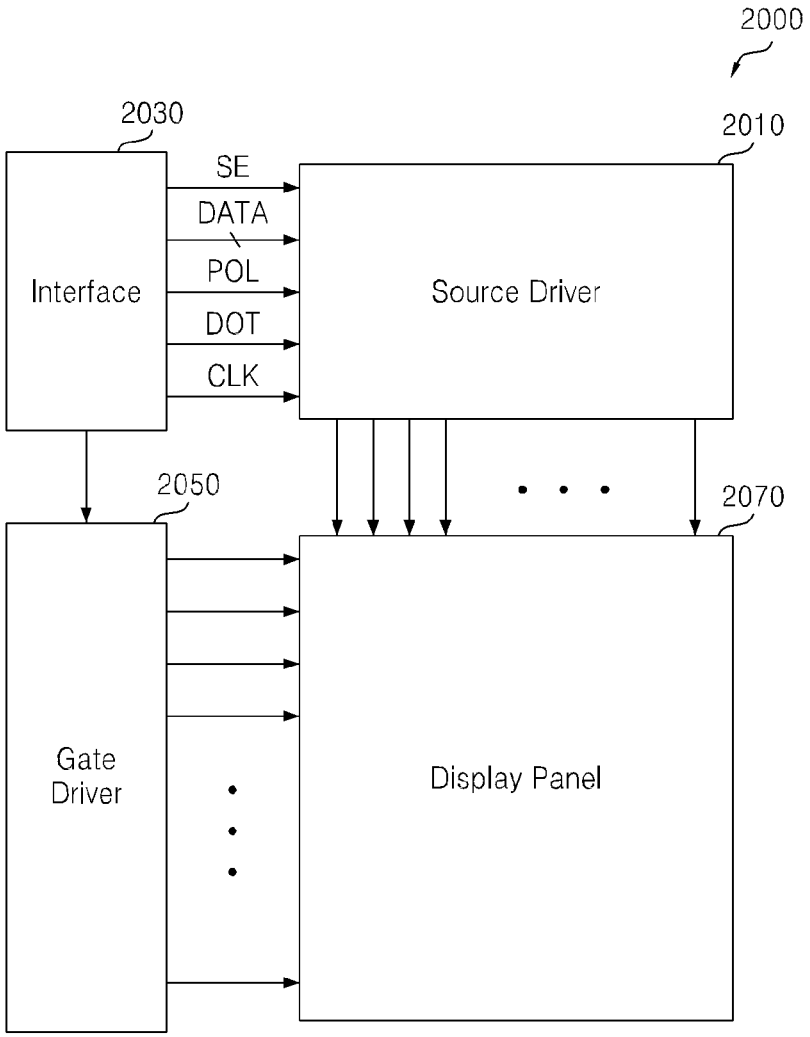
FIG. 32 is a schematic block diagram of a display device including the source driver illustrated in FIG. 1, 17 or 29.

The output buffer circuit 1600 may buffer output signals of the multiplexing circuit 1500 and output the output signals to pixels of a display panel. According to an exemplary embodiment, the output buffer circuit 1600 may include a plurality of amplifiers. Once output signals of the output buffer circuit 1600 are supplied to pixels in response to a gating signal output from a gate driver 2050 (as shown in FIG. 32), an image may be outputted to a display.

According to an exemplary embodiment, the shift register 1100, the control circuit 1200, the data latch circuit 1300, the digital-to-analog conversion circuit 1400, the multiplexing circuit 1500 and the output buffer circuit 1600 may be embodied in one chip or in independent chips.

FIG. 2 is a schematic block diagram of the data latch circuit illustrated in FIG. 1. Referring to FIGS. 1 and 2, the data latch circuit 1300 may include a latch control circuit 1310 and a data latch block 1330.

The latch control circuit 1310 may output a plurality of latch clock signals LCLK as a plurality of latch control signals LCS in response to at least one selection signal SEL.

Figure 10:
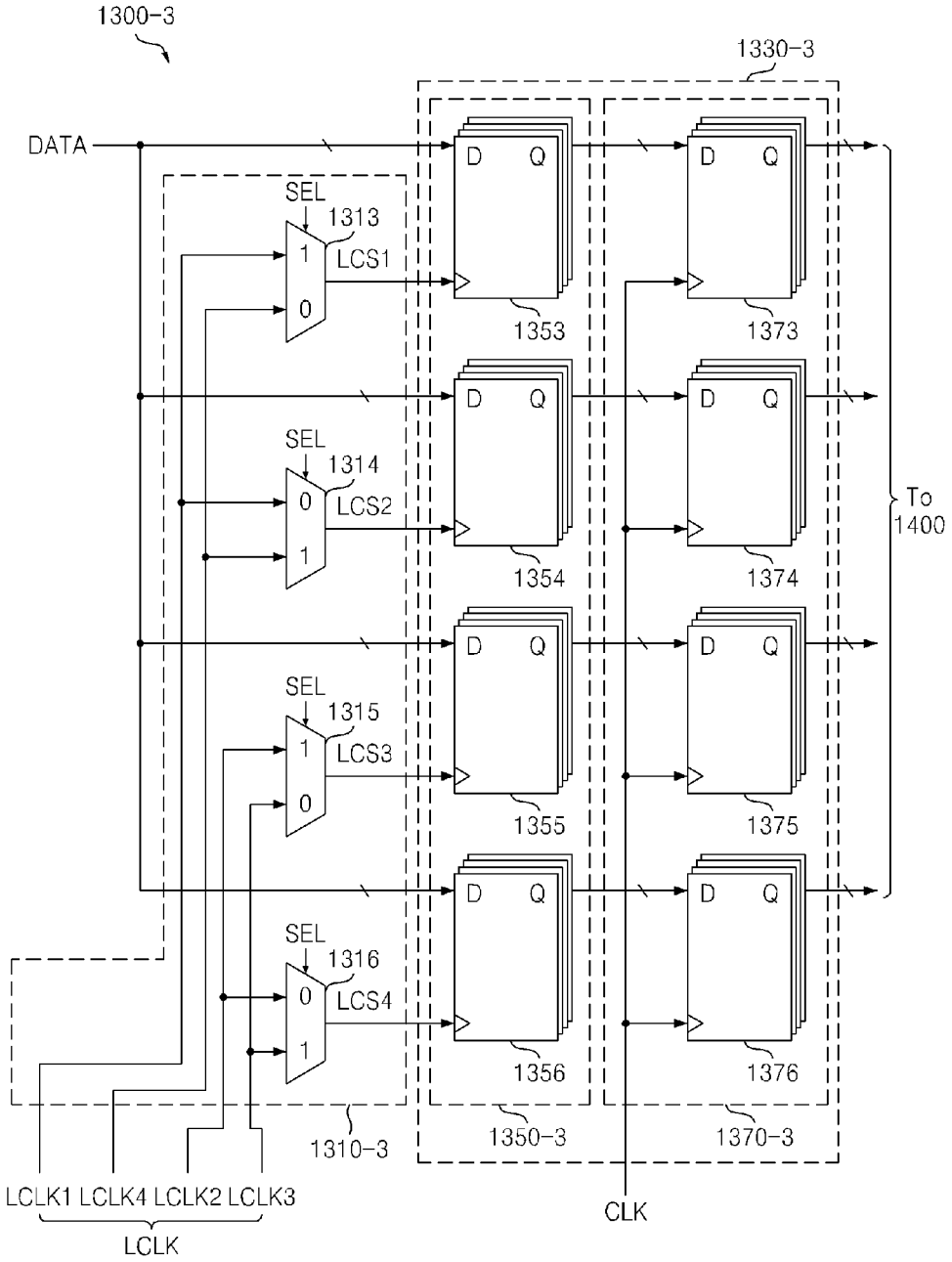
FIG. 10 is a circuit diagram illustrating another exemplary embodiment of the data latch circuit illustrated in FIG. 2.
Figure 16:
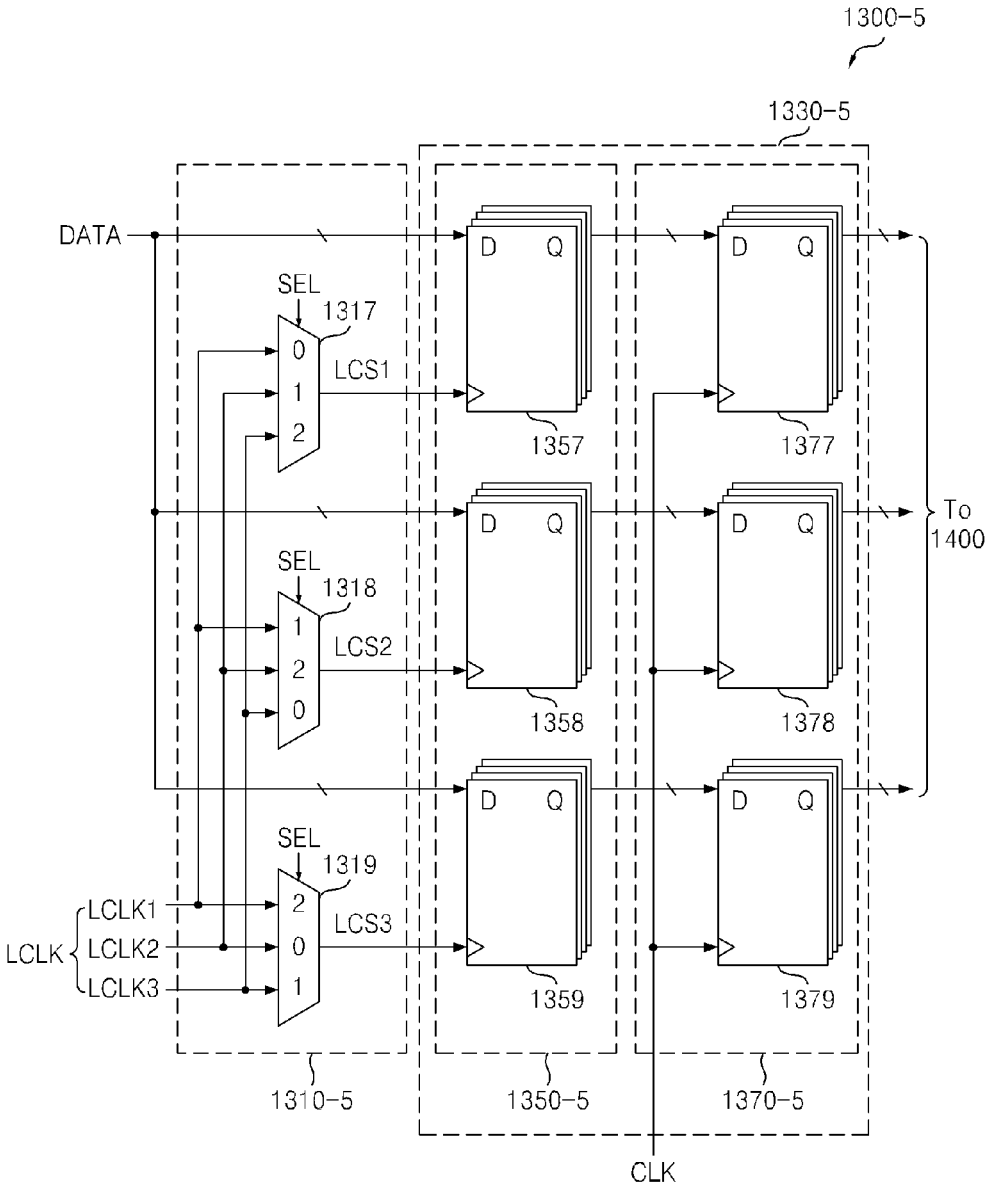
FIG. 16 is a circuit diagram illustrating still another exemplary embodiment of the data latch circuit illustrated in FIG. 2.

For example, the latch control circuit 1310 may be embodied in a plurality of multiplexers 1311 and 1312 (as shown in FIG. 3), 1313 through 1316 (as shown in FIG. 10), or 1317 through 1319 (as shown in FIG. 16), which output one of the plurality of latch clock signals LCLK as one of the plurality of latch control signal LCS in response to at least one selection signal SEL.

The data latch block 1330 may arrange in parallel data blocks DATA, which are input in series, in response to the plurality of latch control signals LCS output from the latch control circuit 1310, and latch the data blocks DATA arranged in parallel simultaneously in response to a clock signal CLK.

The data latch block 1330 may include a first latch circuit 1350 and a second latch circuit 1370. The first latch circuit 1350 arranges in parallel data blocks DATA, which are input in series, in response to the plurality of latch control signals LCS output from the latch control circuit 1310. The second latch circuit 1370 may latch output signals of the first latch circuit 1350, i.e., data blocks DATA arranged in parallel, simultaneously in response to a clock signal CLK.

FIG. 3 is a circuit diagram depicting an exemplary embodiment of the data latch circuit illustrated in FIG. 2, and FIG. 4 is a timing diagram for explaining an operation of the data latch circuit illustrated in FIG. 3.

Referring to FIGS. 1 through 4, a data latch circuit 1300-1 according to an exemplary embodiment of the data latch circuit 1300 may include a latch control circuit 1310-1 and a data latch block 1330-1. The data latch block 1330-1 may include a first latch circuit 1350-1 and a second latch circuit 1370-1.

The latch control circuit 1310-1 may include a plurality of multiplexers 1311 and 1312, the first latch circuit 1350-1 may include a plurality of data latches 1351 and 1352, and the second latch circuit 1370-1 may include a plurality of data latches 1371 and 1372.

The multiplexer 1311 may output one of a plurality of latch clock signals LCLK1 and LCLK2 to the data latch 1351 as a latch control signal LCS1 in response to a selection signal SEL, and the multiplexer 1312 may output the other of the plurality of latch clock signals LCLK1 and LCLK2 to the data latch 1352 as a latch control signal LCS2 in response to the selection signal SEL. That is, each of the plurality of multiplexers 1311 and 1312 may output each of different latch clock signals.

As illustrated in FIG. 4, when the selection signal SEL is at a high level, the multiplexer 1311 may output a latch clock signal LCLK1 as a latch control signal LCS1, and the multiplexer 1312 may output a latch clock signal LCLK2 as a latch control signal LCS2.

On the contrary, when the selection signal SEL is at a low level, the multiplexer 1311 may output a latch clock signal LCLK2 as a latch control signal LCS1, and the multiplexer 1312 may output a latch clock signal LCLK1 as a latch control signal LCS2.

The plurality of latch clock signals LCLK1 and LCLK2 are signals which are non-overlapped with each other or have different timings, so that the plurality of latch control signals LCS1 and LCS2 may be signals which are non-overlapped with each other or have different timings.

In response to a latch control signal LCS1 output from the multiplexer 1311, the data latch 1351 may latch a data block which is input when the latch control signal LCS1 gets activated among data blocks DATA input in series. The data latch 1352, in response to a latch control signal LCS2 output from the multiplexer 1312, may latch a data block which is input when the latch control signal LCS2 gets activated among the data blocks DATA input in series.

As illustrated in FIG. 4, the data latch 1351 may latch a data block Y1-1 or Y2-2 input when a latch control signal LCS1 gets activated, and the data latch 1352 may latch a data block Y2-1 or Y1-2 input when a corresponding latch control signal LCS2 gets activated. D1351 is an output signal of the data latch 1351, and D1352 is an output signal of the data latch 1352.

A data latch 1371 latches the data block D1351 output from the data latch 1351 in response to a clock signal CLK. A data latch 1372 may latch the data block D1352 output from the data latch 1352 in response to a clock signal CLK. That is, each data latch 1371 and 1372 may latch an output signal D1351 and D1352 of each data latch 1351 and 1352 at the same time.

As illustrated in FIG. 4, the data latch 1371 may latch a data block D1351=Y1-1 or D1351=Y2-2 output from the data latch 1351 in response to a clock signal CLK. The data latch 1372 may latch a data block D1352=Y2-1 or D1352=Y1-2 output from the data latch 1352 in response to a clock signal CLK.

Figure 5:
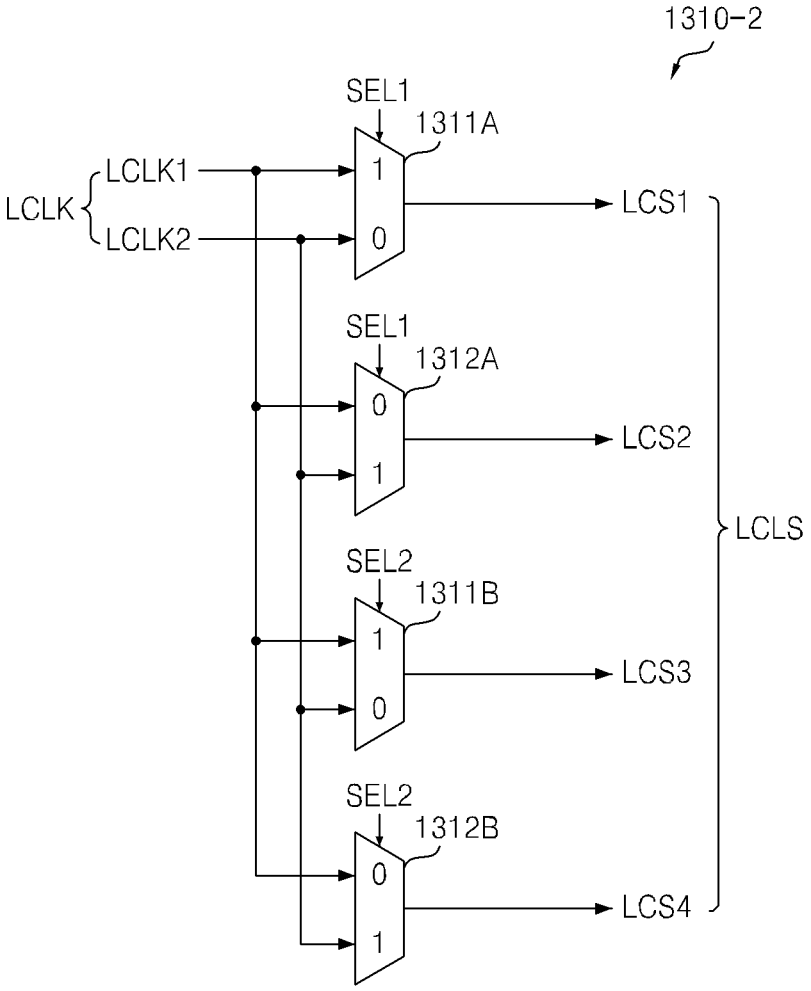
FIG. 5 is a circuit diagram illustrating an exemplary embodiment of a latch control circuit illustrated in FIG. 2.
Figure 6:
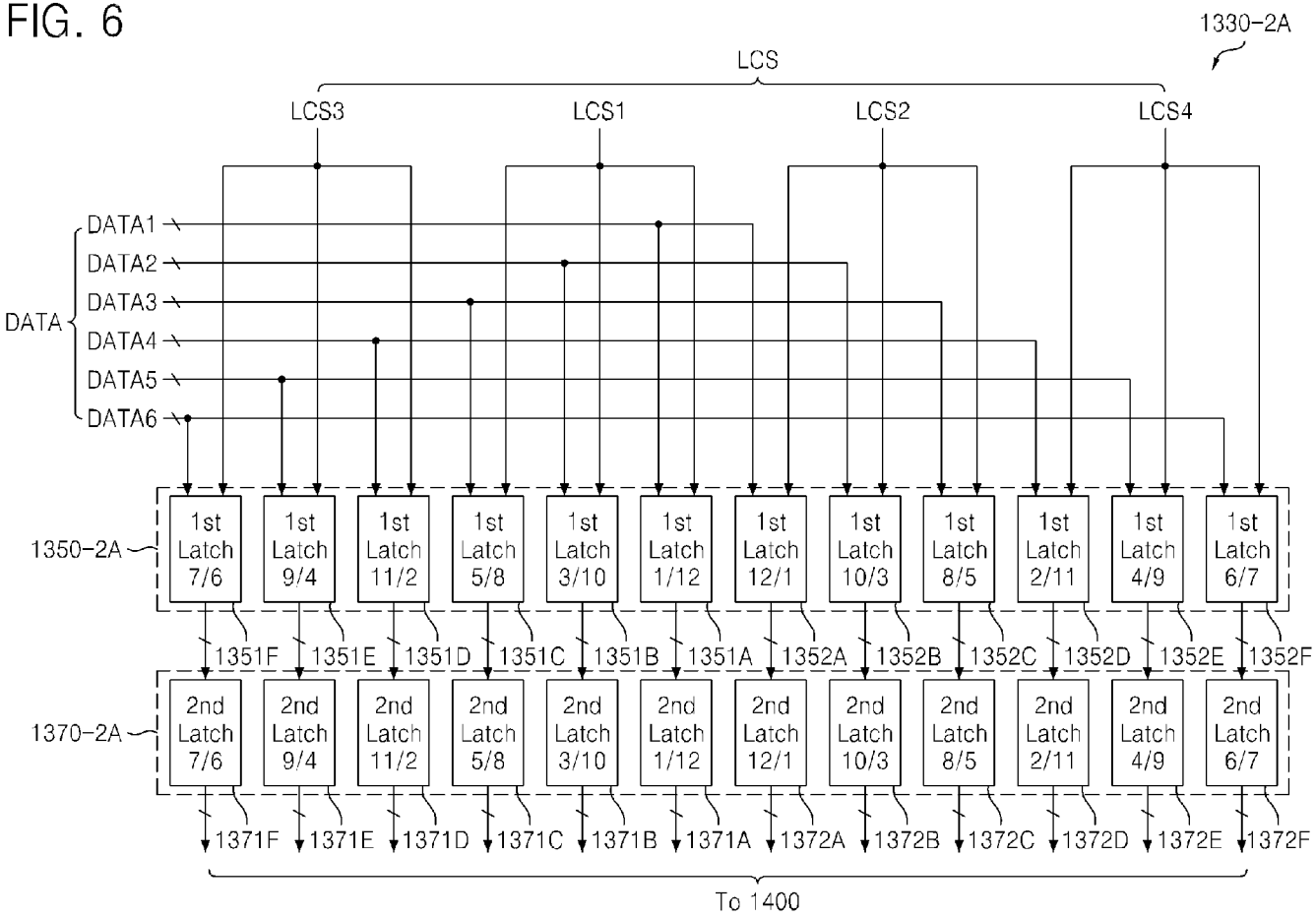
FIG. 6 is a circuit diagram illustrating an exemplary embodiment of a data latch block illustrated in FIG. 2.
Figure 7:
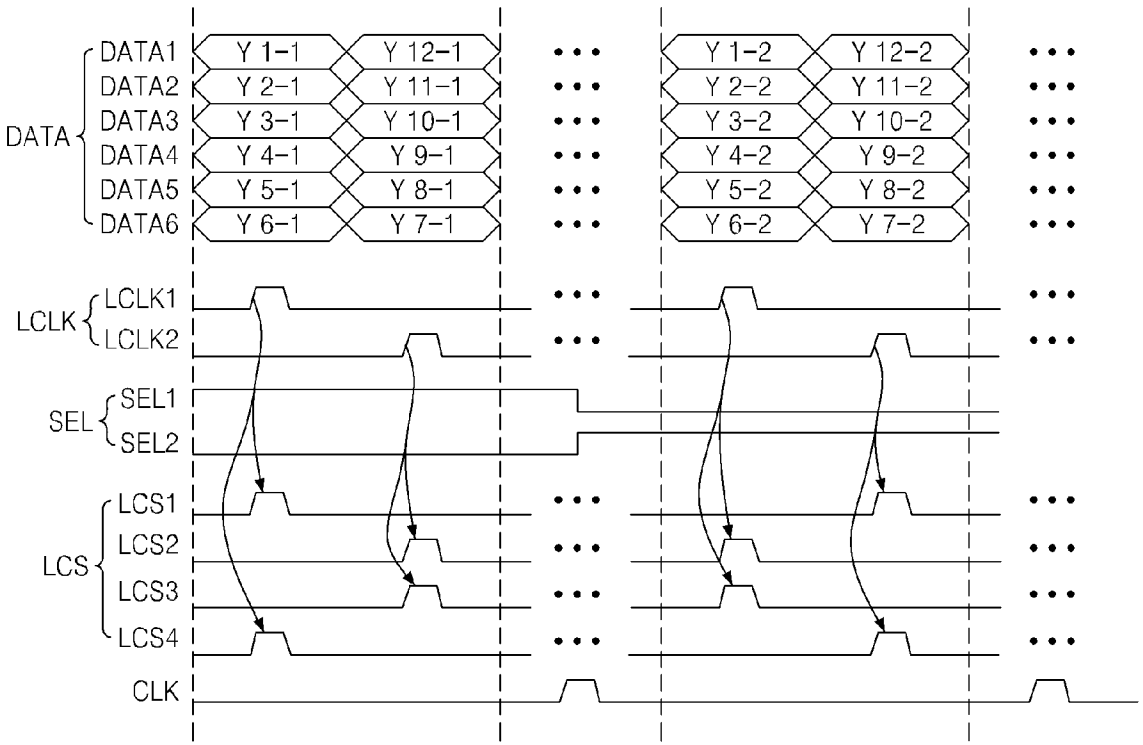
FIG. 7 is a timing diagram illustrating an exemplary embodiment of an operation of a data latch circuit illustrated in FIG. 6.
Figure 8:
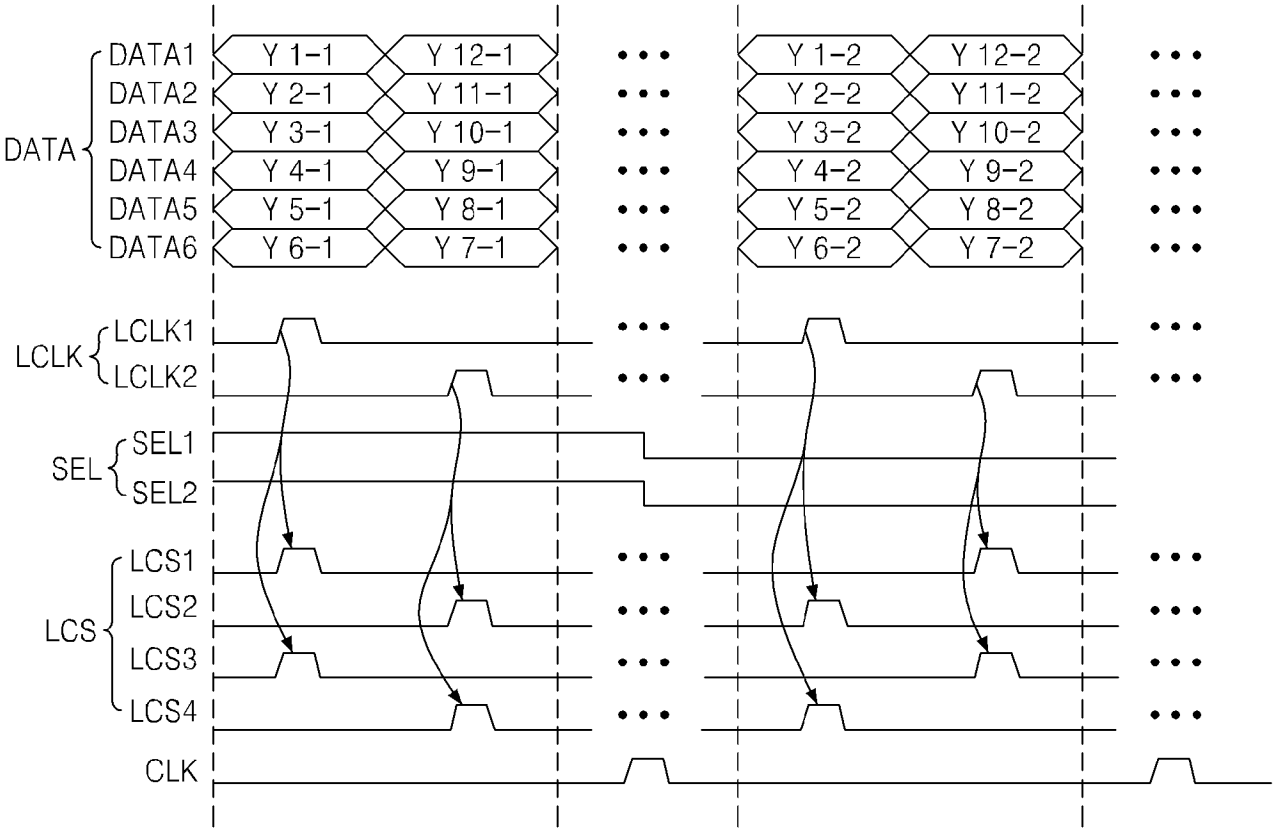
FIG. 8 is a timing diagram illustrating another exemplary embodiment of the operation of the data latch circuit illustrated in FIG. 6.

FIG. 5 is a circuit diagram depicting an exemplary embodiment of the latch control circuit illustrated in FIG. 2, FIG. 6 is a circuit diagram depicting an exemplary embodiment of the data latch block illustrated in FIG. 2, FIG. 7 is a timing diagram for explaining an exemplary embodiment of an operation of the data latch circuit illustrated in FIG. 6, and FIG. 8 is a timing diagram for explaining another exemplary embodiment of the operation of the data latch circuit illustrated in FIG. 6.

Referring to FIGS. 1, 2 and 5 through 8, a latch control circuit 1310-2 according to an exemplary embodiment of the latch control circuit 1310 of FIG. 2 may include a plurality of multiplexers 1311A, 1312A, 1311B and 1312B. The data latch block 1330-2A may include a first latch circuit 1350-2A and a second latch circuit 1370-2A.

The first latch circuit 1350-2A may include data latches 1351A through 1351F and 1352A through 1352F. The second latch circuit 1370-2A may include data latches 1371A through 1371F and 1372A through 1372F.

A data latch circuit 1300, which outputs a plurality of data blocks input through a bus with a width of 6 bits, through 12 channels, is exemplarily illustrated in FIG. 6; however, the present general inventive concept is not restricted thereto.

A function and an operation of each of multiplexers 1311A and 1311B of FIG. 5 are identical or similar to a function and an operation of the multiplexer 1311 of FIG. 3, and a function and an operation of each of multiplexers 1312A and 1312B are identical or similar to a function and an operation of the multiplexer 1312 of FIG. 3.

A multiplexer 1311A may output one of a plurality of latch clock signals LCLK1 and LCLK2 in response to a selection signal SEL1 as a latch control signal LCS1, and a multiplexer 1312A may output the other of the plurality of latch clock signals LCLK1 and LCLK2 in response to the selection signal SEL1 as a latch control signal LCS2.

As illustrated in FIG. 7, when the selection signal SEL1 is at a high level, the multiplexer 1311A may output a latch clock signal LCLK1 as a latch control signal LCS1 and the multiplexer 1312A may output a latch clock signal LCLK2 as a latch control signal LCS2.

On the contrary, when the selection signal SEL1 is at a low level, the multiplexer 1311A may output a latch clock signal LCLK2 as a latch control signal LCS1 and the multiplexer 1312A may output a latch clock signal LCLK1 as a latch control signal LCS2.

A multiplexer 1311B may output one of the plurality of latch clock signals LCLK1 and LCLK2 as a latch control signal LCS3 in response to a selection signal SEL2, and a multiplexer 1312B may output the other of the plurality of latch clock signals LCLK1 and LCLK2 as a latch control signal LCS4 in response to the selection signal SEL2.

As illustrated in FIG. 7, when the selection signal SEL2 is at a high level, the multiplexer 1311B may output a latch clock signal LCLK1 as a latch control signal LCS3 and the multiplexer 1312B may output a latch clock signal LCLK2 as a latch control signal LCS4.

On the contrary, when the selection signal SEL2 is at a low level, the multiplexer 1311B may output a latch clock signal LCLK2 as a latch control signal LCS3 and the multiplexer 1312B may output a latch clock signal LCLK1 as a latch control signal LCS4.

A function and an operation of each of data latches 1351A through 1351F of FIG. 6 are similar to a function and an operation of the data latch 1351 of FIG. 3, and a function and an operation of each of data latches 1353A through 1353F are similar to a function and an operation of the data latch 1352 of FIG. 3.

Each of data latches 1351A and 1352A, data latches 1351B and 1352B, data latches 1351C and 1352C, data latches 1351D and 1352D, data latches 1351E and 1352E, and data latches 1351F and 1352F may receive data blocks DATA1 through DATA6 input in series through an identical bus.

Each of a plurality of data latches 1351A through 1351F and 1352A through 1352F may latch a data block which is input when a corresponding latch control signal LCS1 through LCS6 gets activated. For example, referring to FIGS. 6 and 7, a data latch 1351A may latch a data block Y1-1 or Y12-2 which is input when a corresponding latch control signal LCS1 gets activated, and a data latch 1352A may latch a data block Y12-1 or Y1-2 which is input when a corresponding latch control signal LCS2 gets activated.

A function and an operation of each of data latches 1371A through 1371F of FIG. 6 are similar to a function and an operation of the data latch 1371 of FIG. 3, and a function and an operation of each of data latches 1372A through 1372F of FIG. 6 are similar to a function and an operation of the data latch 1372 of FIG. 3.

Each of a plurality of data latches 1371A through 1371F and 1372A through 1372F may latch a data block output from a corresponding data latch, i.e., one of 1351A through 1351F and 1352A through 1352F in response to clock signal (CLK). For example, a data latch 1371A may latch a data block Y1-1 or Y12-2 output from a data latch 1351A in response to a clock signal CLK. A data latch 1372A may latch a data block Y12-1 or Y1-2 output from a data latch 1352A in response to the clock signal CLK.

A data block latched by the plurality of data latches 1371A through 1371F and 1372A through 1372F may be outputted to the digital-to-analog conversion circuit 1400.

When the control circuit 1200 generates selection signals SEL1 and SEL2 as illustrated in FIG. 7, the source driver 1010 may operate in a one-DOT inversion mode, e.g., polarity of analog signals supplied to adjacent pixels is different from each other.

On the other hand, when the control circuit 1200 generates selection signal SEL1 and SEL2 as illustrated in FIG. 8, the source driver 1010 may operate in a six-DOT inversion mode, e.g., polarity of analog signals supplied to adjacent six pixels is identical to each other and polarity of analog signals supplied to the six pixels is different from polarity of analog signals supplied to another six pixels adjacent to the six pixels.

Figure 9:
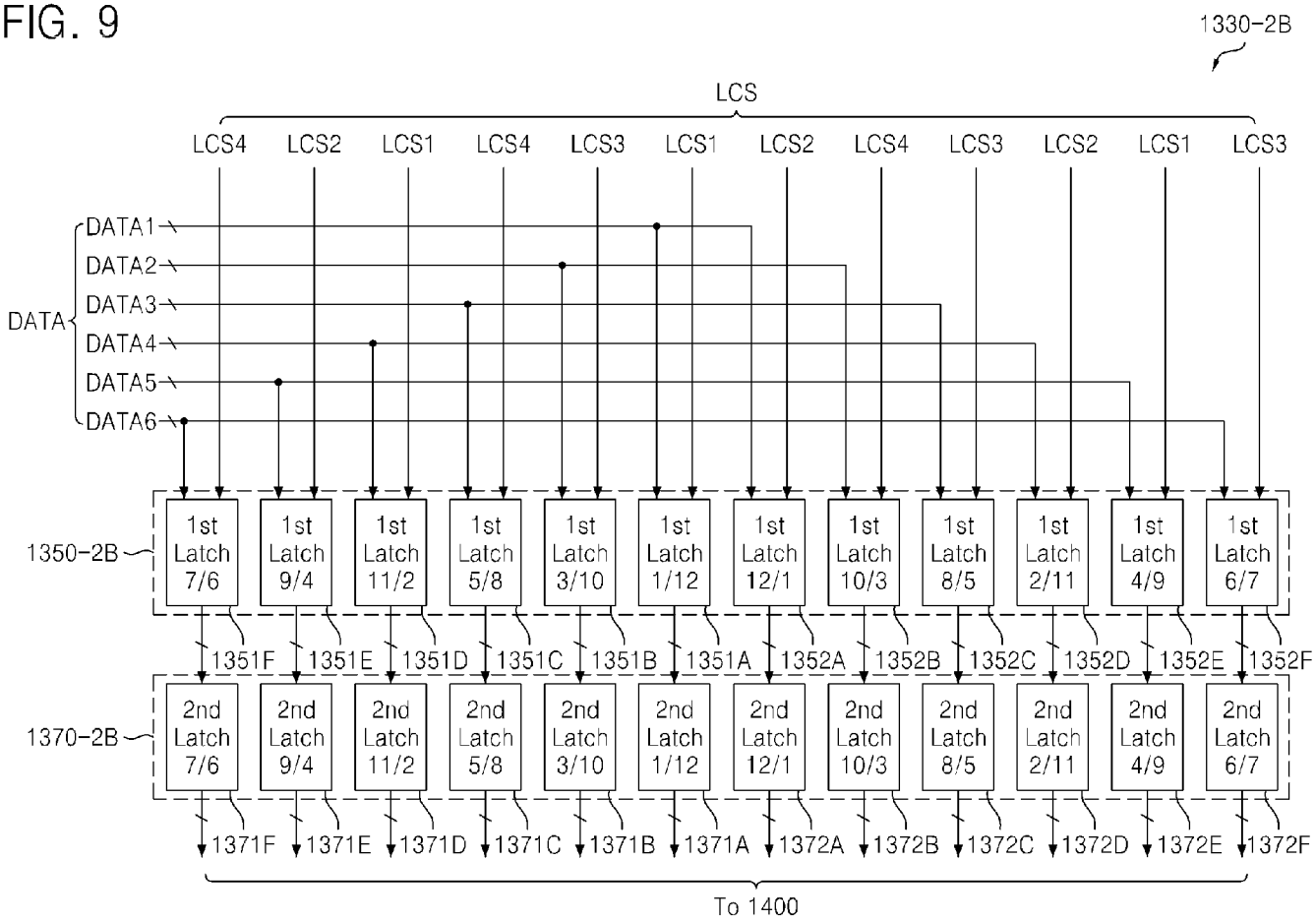
FIG. 9 is a circuit diagram illustrating another exemplary embodiment of the data latch block illustrated in FIG. 2.

FIG. 9 is a circuit diagram depicting another exemplary embodiment of the data latch block 1330 illustrated in FIG. 2. Referring to FIGS. 1, 2, 5, and 7 through 9, a data latch block 1330-2B may include a first latch circuit 1350-2B and a second latch circuit 1370-2B.

The first latch circuit 1350-2B may include data latches 1351A through 1351F and 1352A through 1352F. The second latch circuit 1370-2B may include data latches 1371A through 1371F and 1372A through 1372F.

A function and an operation of each of a plurality of data latches 1351A through 1351F, 1352A through 1352F, 1371A through 1371F, and 1372A through 1372F of FIG. 9 are substantially the same as a function and an operation of each of the plurality of data latches 1351A through 1351F, 1352A through 1352F, 1371A through 1371F, and 1372A through 1372F of FIG. 6 except for an input path of a plurality of latch control signals LCS1 through LCS4.

Each of the data latches 1351A, 1351D and 1352E latches a data block input when a latch control signal LCS1 gets activated. Each of the data latches 1352D, 1352A and 1351E latches a data block input when a latch control signal LCS2 gets activated.

Each of the data latches 1351B, 1352C and 1352F latches a data block input when a latch control signal LCS3 gets activated. Each of the data latches 1351C, 1351F and 1352B may latch a data block input when a latch control signal LCS4 gets activated. For example, the data latch 1351A may latch a data block Y1-1 or Y12-2 input when a corresponding latch control signal LCS1 gets activated, and the data latch 1352A may latch a data block Y12-1 or Y1-2 input when a corresponding latch control signal LCS2 gets activated.

When the control circuit 1200 generates selection signals SEL1 and SEL2 as illustrated in FIG. 7, the source driver 1010 may operate in a two-DOT inversion mode, e.g., polarity of analog signals supplied to two adjacent pixels is identical to each other and polarity of analog signals supplied to the two pixels is different from polarity of analog signals supplied to another two pixels adjacent to the two pixels.

On the other hand, when the control circuit 1200 generates the selection signals SEL1 and SEL2 as illustrated in FIG. 8, the source driver 1010 may operate in a three-DOT inversion mode, e.g., polarity of analog signals supplied to three neighboring pixels is identical to each other and polarity of analog signals supplied to the three pixels is different from polarity of analog signals supplied to another three pixels adjacent to the three pixels.

Figure 11:
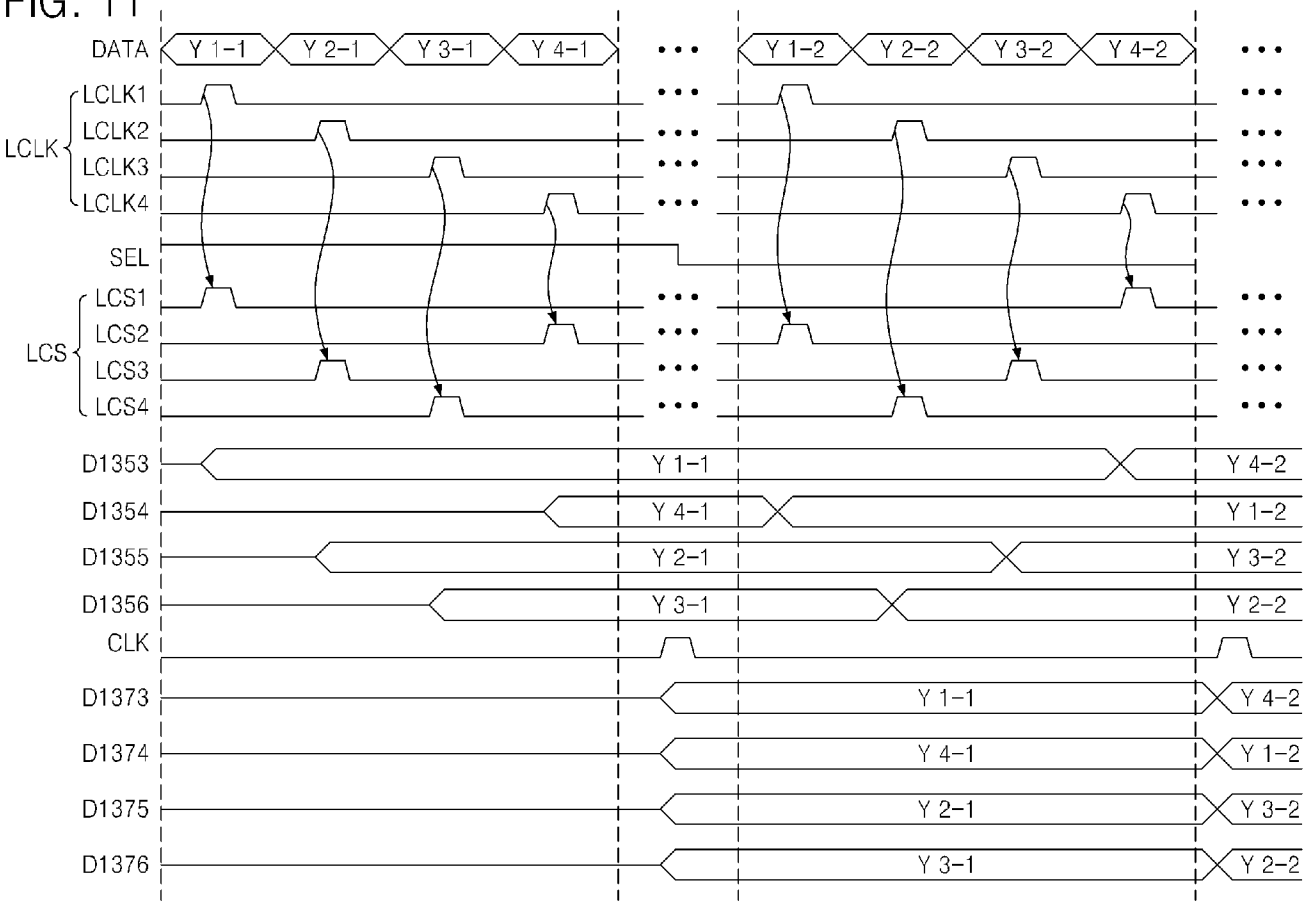
FIG. 11 is a timing diagram illustrating an operation of a data latch circuit illustrated in FIG. 9.

FIG. 10 is a circuit diagram depicting another exemplary embodiment of the data latch circuit illustrated in FIG. 2, and FIG. 11 is a timing diagram for explaining an operation of the data latch circuit illustrated in FIG. 9. Referring to FIGS. 1, 2, 10 and 11, a data latch circuit 1300-3 may include a latch control circuit 1310-3 and a data latch block 1330-3. The data latch block 1330-3 may include a first latch circuit 1350-3 and a second latch circuit 1370-3.

The latch control circuit 1310-3 may include a plurality of multiplexers 1313 through 1316, the first latch circuit 1350-3 may include a plurality of data latches 1353 through 1356, and the second latch circuit 1370-3 may include a plurality of data latches 1373 through 1376.

Each multiplexer 1313 through 1316 may output a corresponding one of a plurality of latch clock signals LCLK1 through LCLK4 as each latch control signal LCS1 through LCS4 in response to a selection signal SEL. For example, a multiplexer 1313 may output one of the plurality of latch clock signals LCLK1 and LCLK4 to a data latch 1353 in response to a selection signal SEL as a latch control signal LCS1. A multiplexer 1314 may output the other of the plurality of latch clock signals LCLK1 and LCLK4 to a data latch 1354 as a latch control signal LCS2 in response to the selection signal SEL.

A multiplexer 1315 may output one of a plurality of latch clock signals LCLK2 and LCLK3 to a data latch 1355 as a latch control signal LCS3 in response to the selection signal SEL. A multiplexer 1316 may output the other of the plurality of latch clock signals LCLK2 and LCLK3 to a data latch 1356 as a latch control signal LCS4 in response to the selection signal SEL. That is, each of the multiplexers 1313 through 1316 may output a corresponding one of different latch clock signals as a latch control signal.

As illustrated in FIG. 11, when the selection signal SEL is at a high level, the multiplexer 1313 may output a latch clock signal LCLK1 as a latch control signal LCS1, the multiplexer 1314 may output a latch clock signal LCLK4 as a latch control signal LCS2, the multiplexer 1315 may output a latch clock signal LCLK2 as a latch control signal LCS3, and the multiplexer 1316 may output a latch clock signal LCLK3 as a latch control signal LCS4.

On the contrary, when the selection signal SEL is at a low level, the multiplexer 1313 may output a latch clock signal LCLK4 as a latch control signal LCS1, the multiplexer 1314 may output a latch clock signal LCLK1 as a latch control signal LCS2, the multiplexer 1315 may output a latch clock signal LCLK3 as a latch control signal LCS3, and the multiplexer 1316 may output a latch clock signal LCLK2 as a latch control signal LCS4.

The plurality of latch clock signals LCLK1 through LCLK4 are signals non-overlapping each other, so that the plurality of latch control signals LCS1 through LCS4 may be signals non-overlapping each other.

Each of data latches 1353 through 1356 may latch a data block DATA which is input through a bus when the latch control signal LCS1 through LCS4 output from a corresponding multiplexer 1313 through 1316 gets activated.

As illustrated in FIG. 11, a data latch 1353 may latch a data block Y1-1 or Y4-2 input when a corresponding latch control signal LCS1 gets activated, a data latch 1354 may latch a data block Y4-1 or Y1-2 input when a corresponding latch control signal LCS2 gets activated, a data latch 1355 may latch a data block Y2-1 or Y3-2 input when a corresponding latch control signal LCS3 gets activated, and a data latch 1356 may latch a data block Y3-1 or Y2-2 input when a corresponding latch control signal LCS4 gets activated.

Each data latch 1373 through 1376 may latch a data block output from each corresponding data latch 1353 through 1356 in response to a clock signal CLK.

As illustrated in FIG. 11, a data latch 1373 may latch a data block Y1-1 or Y4-2 output from the data latch 1353 in response to the clock signal CLK, a data latch 1374 may latch a data block Y4-1 or Y1-2 output from the data latch 1354 in response to the clock signal CLK, a data latch 1375 may latch a data block Y2-1 or Y3-2 output from the data latch 1355 in response to the clock signal CLK, and a data latch 1376 may latch a data block Y3-1 or Y2-2 output from the data latch 1356 in response to the clock signal CLK.

Each signal D1353 through D1356 and D1373 through D1376 means an output signal of each latch 1353 through 1356 and 1373 through 1376.

Figure 12:
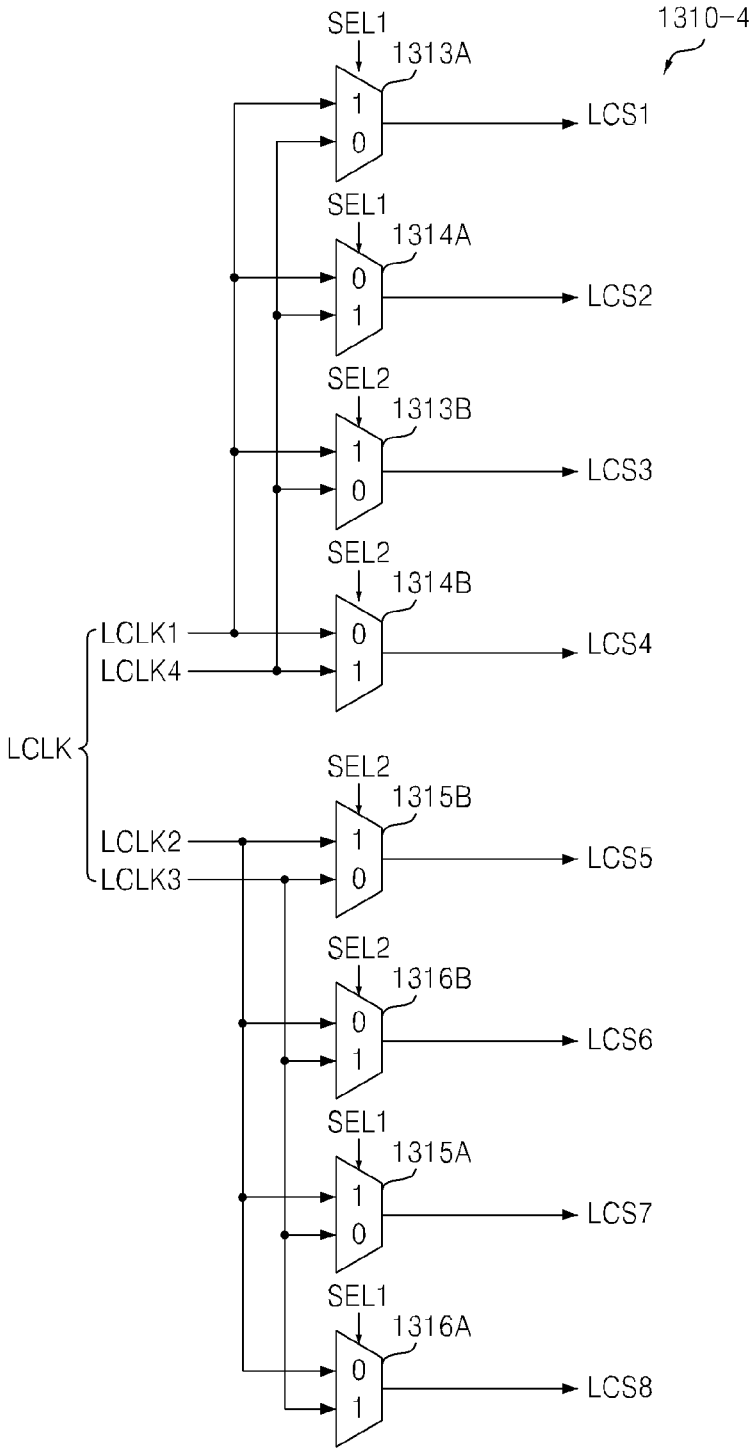
FIG. 12 is a circuit diagram illustrating another exemplary embodiment of the latch control circuit illustrated in FIG. 2.
Figure 13:
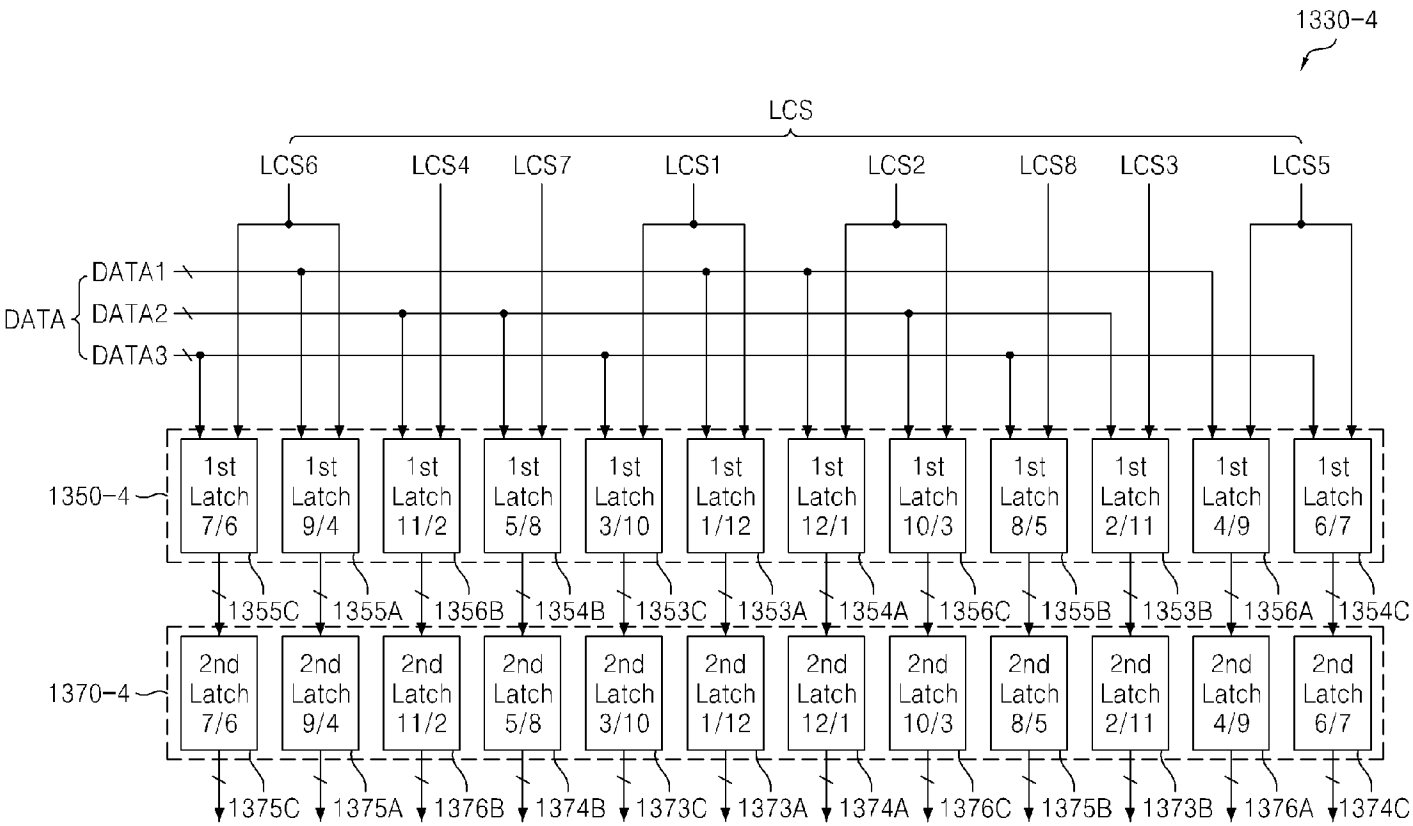
FIG. 13 is a circuit diagram illustrating still another exemplary embodiment of the data latch block illustrated in FIG. 2.
Figure 14:
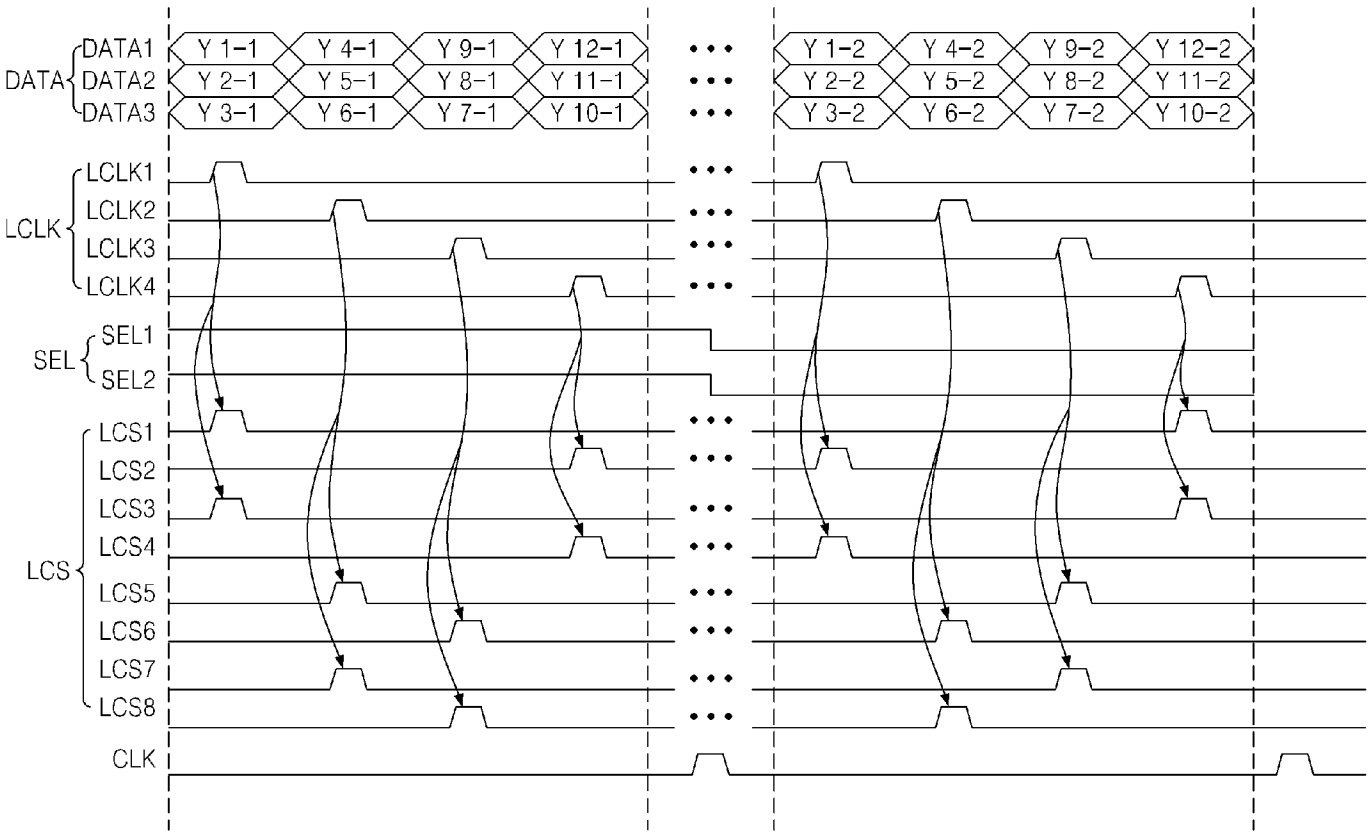
FIG. 14 is a timing diagram illustrating an exemplary embodiment of an operation of a data latch block illustrated in FIG. 13.
Figure 15:
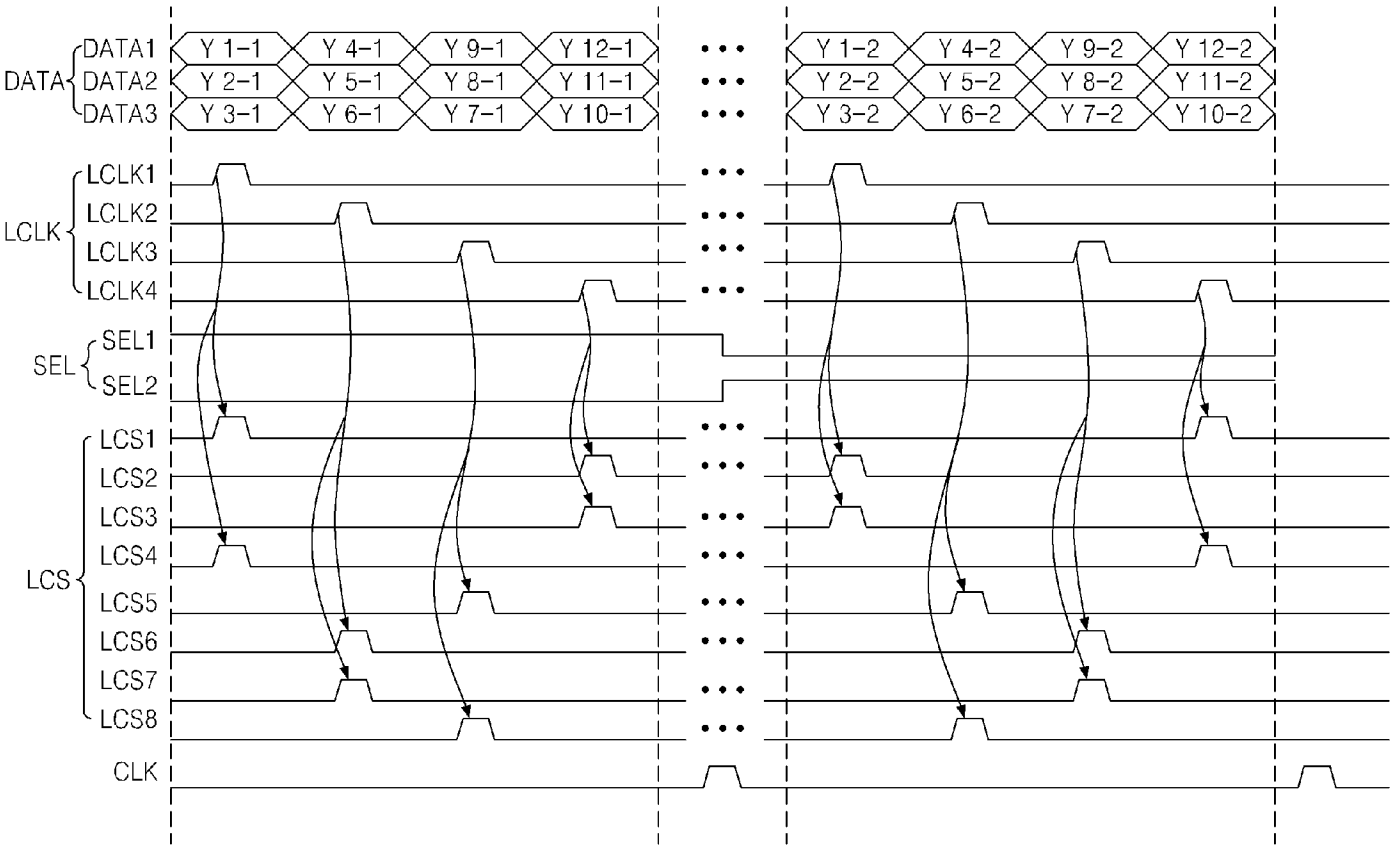
FIG. 15 is a timing diagram illustrating another exemplary embodiment of the operation of the data latch block illustrated in FIG. 13.

FIG. 12 is a circuit diagram depicting another exemplary embodiment of the latch control circuit illustrated in FIG. 2. FIG. 13 is a circuit diagram depicting still another exemplary embodiment of the data latch block illustrated in FIG. 2. FIG. 14 is a timing diagram for explaining an exemplary embodiment of an operation of the data latch block illustrated in FIG. 13. FIG. 15 is a timing diagram for explaining another exemplary embodiment of the operation of the data latch block illustrated in FIG. 13.

Referring to FIGS. 1, 2, and 12 through 15, a latch control circuit 1310-4 may include a plurality of multiplexers 1313A through 1316A and 1313B through 1316B. A data latch block 1330-4 of FIG. 13 may include a first latch circuit 1350-4 and a second latch circuit 1370-4. The first latch circuit 1350-4 may include a plurality of data latches 1353A through 1356A, 1353B through 1356B, and 1353C through 1356C, and the second latch circuit 1370-4 may include a plurality of data latches 1373A through 1376A, 1373B through 1376B, and 1373C through 1376C.

A data latch circuit, which includes a data latch block 1330-4 outputting a plurality of data blocks, input through a bus with a width of three bits, through twelve channels, is exemplarily illustrated in FIG. 13. The present general inventive concept, however, is not restricted thereto.

A function and an operation of each of multiplexers 1313A and 1313B of FIG. 12 are equal or similar to a function and an operation of the multiplexer 1313 of FIG. 10, a function and an operation of each of multiplexers 1314A and 1314B are equal or similar to a function and an operation of the multiplexer 1314 of FIG. 10, a function and an operation of each of multiplexers 1315A and 1315B are equal or similar to a function and an operation of the multiplexer 1315 of FIG. 10, and a function and an operation of each of multiplexers 1316A and 1316B are equal or similar to a function and an operation of the multiplexer 1316 of FIG. 10.

Each of the multiplexers 1313A through 1316A and 1313B through 1316B of FIG. 12 may output a plurality of latch clock signals LCLK1 through LCLK4 as a plurality of latch control signals LCS1 through LCS4 in response to a corresponding selection signal SEL1 or SEL2.

As illustrated in FIGS. 14 and 15, when a selection signal SEL1 is at a high level, a multiplexer 1313A may output a latch clock signal LCLK1 as a latch control signal LCS1, a multiplexer 1314A may output a latch clock signal LCLK4 as a latch control signal LCS2, a multiplexer 1315A may output a latch clock signal LCLK2 as a latch control signal LCS7, and a multiplexer 1316A may output a latch clock signal LCLK3 as a latch control signal LCS8.

On the contrary, when the selection signal SEL1 is at a low level, the multiplexer 1313A may output a latch clock signal LCLK4 as a latch control signal LCS1, the multiplexer 1314A may output a latch clock signal LCLK1 as a latch control signal LCS2, the multiplexer 1315A may output a latch clock signal LCLK3 as a latch control signal LCS7, and the multiplexer 1316A may output a latch clock signal LCLK2 as a latch control signal LCS8.

A function and an operation of the multiplexers 1313A through 1316A are complementary to a function and an operation of the multiplexers 1313B through 1316B, so that an explanation for this is omitted.

A function and an operation of each of data latches 1353A through 1353C of FIG. 13 are similar to a function and an operation of the data latch 1353 of FIG. 10, a function and an operation of each of data latches 1354A through 1354C of FIG. 13 are similar to a function and an operation of the data latch 1354 of FIG. 10, a function and an operation of each of data latches 1355A through 1355C of FIG. 13 are similar to a function and an operation of the data latch 1355 of FIG. 10, and a function and an operation of each of data latches 1356A through 1356C of FIG. 13 are similar to a function and an operation of the data latch 1356 of FIG. 10.

Each of the data latches 1353A, 1354A, 1355A and 1356A, data latches 1353B, 1354B, 1355B and 1356B, and data latches 1353C, 1354C, 1355C and 1356C may receive data blocks DATA1 through DATA3 input in series through an identical bus.

Each of the plurality of data latches 1353A through 1356A, 1353B through 1356B and 1353C through 1356C may latch a data block input when a corresponding latch control signal LCS1 through LCS8 gets activated. For example, the data latch 1353A may latch a data block Y1-1 or Y12-2 input when a corresponding latch control signal LCS1 gets activated, and the data latch 1353B may latch a data block Y2-1 or Y11-2 input when a corresponding latch control signal LCS3 gets activated.

A function and an operation of each of data latches 1373A through 1373C of FIG. 13 are similar to a function and an operation of the data latch 1373 of FIG. 10, a function and an operation of each of data latches 1374A through 1374C of FIG. 13 are similar to a function and an operation of the data latch 1374 of FIG. 10, a function and an operation of each of data latches 1375A through 1375C of FIG. 13 are similar to a function and an operation of the data latch 1375 of FIG. 10, and a function and an operation of each of data latches 1376A through 1376C of FIG. 13 are similar to a function and an operation of the data latch 1376 of FIG. 10.

Each of the plurality of data latches 1373A through 1376A, 1373B through 1376B and 1373C through 1376C may latch a data block output from a corresponding data latch, i.e., one of 1353A through 1356A, 1353B through 1356B and 1353C through 1356C, in response to a clock signal CLK. For example, a data latch 1373A may latch a data block Y1-1 or Y12-2 output from a data latch 1353A in response to a clock signal CLK, and a data latch 1373B may latch a data block Y2-1 or Y11-2 output from a data latch 1353B in response to a clock signal CLK.

A data block latched by the plurality of data latches 1373A through 1376A, 1373B through 1376B and 1373C through 1376C may be output to the digital-to-analog conversion circuit 1400.

When the control circuit 1200 generates the selection signals SEL1 and SEL2 as illustrated in FIG. 14, the source driver 1010 may operate in a one-DOT inversion mode.

On the other hand, when the control circuit 1200 generates the selection signals SEL1 and SEL2 as illustrated in FIG. 15, the source driver 1010 may operate in a six-DOT inversion mode.

The number of multiplexers included in the latch control circuit 1310-4 illustrated in FIGS. 12 and 13 is less than the number of multiplexers included in conventional data latch circuits. Accordingly, the size of a chip where a data latch circuit is embodied may be reduced.

FIG. 16 is a circuit diagram depicting still another exemplary embodiment of the data latch circuit illustrated in FIG. 2. Referring to FIGS. 1, 2 and 16, a data latch circuit 1300-5 may include a latch control circuit 1310-5 and a data latch block 1330-5. The data latch block 1330-5 may include a first latch circuit 1350-5 and a second latch circuit 1370-5.

The latch control circuit 1310-5 may include a plurality of multiplexers 1317 through 1319, the first latch circuit 1350-5 may include a plurality of data latches 1357 through 1359, and the second latch circuit 1370-5 may include a plurality of data latches 1377 through 1379.

Each of the plurality of multiplexers 1317 through 1319 may output one of a plurality of latch clock signals LCLK1 through LCLK3 as a latch control signal LCS1 through LCS3 in response to a selection signal SEL. Each of the plurality of multiplexers 1317 through 1319 may output each of different latch clock signals LCLK1 through LCLK3 as each of the latch control signals LCS1 through LCS3. Since the plurality of latch clock signals LCLK1 through LCLK3 are signals non-overlapping each other, the plurality of latch control signals LCS1 through LCS3 are non-overlapping signals each other.

Each data latch 1357 through 1359 may latch a data block DATA input through a bus when a latch control signal LCS1 through LCS3 output from a corresponding multiplexer 1317 through 1319 gets activated. Each data latch 1377 through 1379 may latch a data block output from a corresponding data latch 1357 through 1359 in response to a clock signal CLK.

Figure 17:
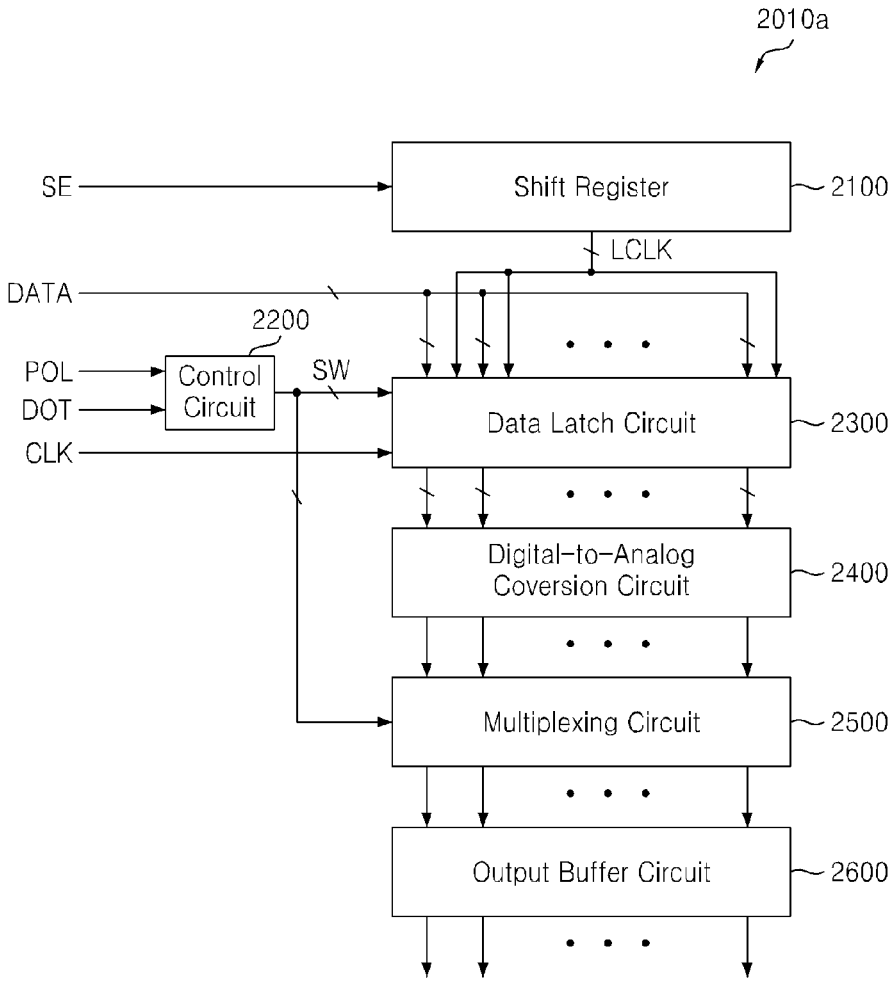
FIG. 17 is a schematic block diagram of a source driver according to another exemplary embodiment of the present general inventive concept.

FIG. 17 is a schematic block diagram of a source driver according to another exemplary embodiment of the present general inventive concept. Referring to FIG. 17, a source driver 2010*a* includes a shift register 2100, a control circuit 2200, a data latch circuit 2300, a digital-to-analog conversion circuit 2400, a multiplexing circuit 2500 and an output buffer circuit 2600.

The shift register 2100 may output a plurality of latch clock signals LCLK successively to the data latch circuit 2300 in response to a start signal SE for starting an operation of the source driver 2010*a*. The plurality of latch clock signals LCLK may be non-overlapped.

The control circuit 2200 may output a plurality of selection signals SW based on a polarity control signal POL and an inversion mode control signal DOT.

The polarity control signal POL may be a signal converted in every frame. For example, when the polarity control signal POL is at a high level in one frame, the polarity control signal POL may become a low level in the next frame. The inversion mode control signal DOT is a signal for controlling an inversion mode of a display panel. When the inversion mode control signal DOT indicates an n-DOT inversion mode, where n is a natural number, the control circuit 2200 may generate a plurality of selection signals SW so that the source driver 2010*a* may operate in the n-DOT inversion mode.

For example, when the inversion mode control signal DOT indicates a one-DOT inversion mode, the control circuit 2200 may generate a plurality of selection signals SW so that the source driver 2010*a* may operate in the one-DOT inversion mode, i.e., polarity of analog signals supplied to adjacent pixels is different from each other.

As another example, when the inversion mode control signal DOT indicates an n-DOT inversion mode, the control circuit 2200 may generate a plurality of selection signals SW so that the source driver 2010*a* may operate in the n-DOT inversion mode, i.e., polarity of analog signals supplied to n adjacent pixels is identical to each other and polarity of analog signals supplied to the n pixels is different from polarity of analog signals supplied to another n pixels adjacent to the n pixels.

The data latch circuit 2300 may latch data blocks in response to a clock signal CLK and a plurality of selection signals SW.

Figure 18:
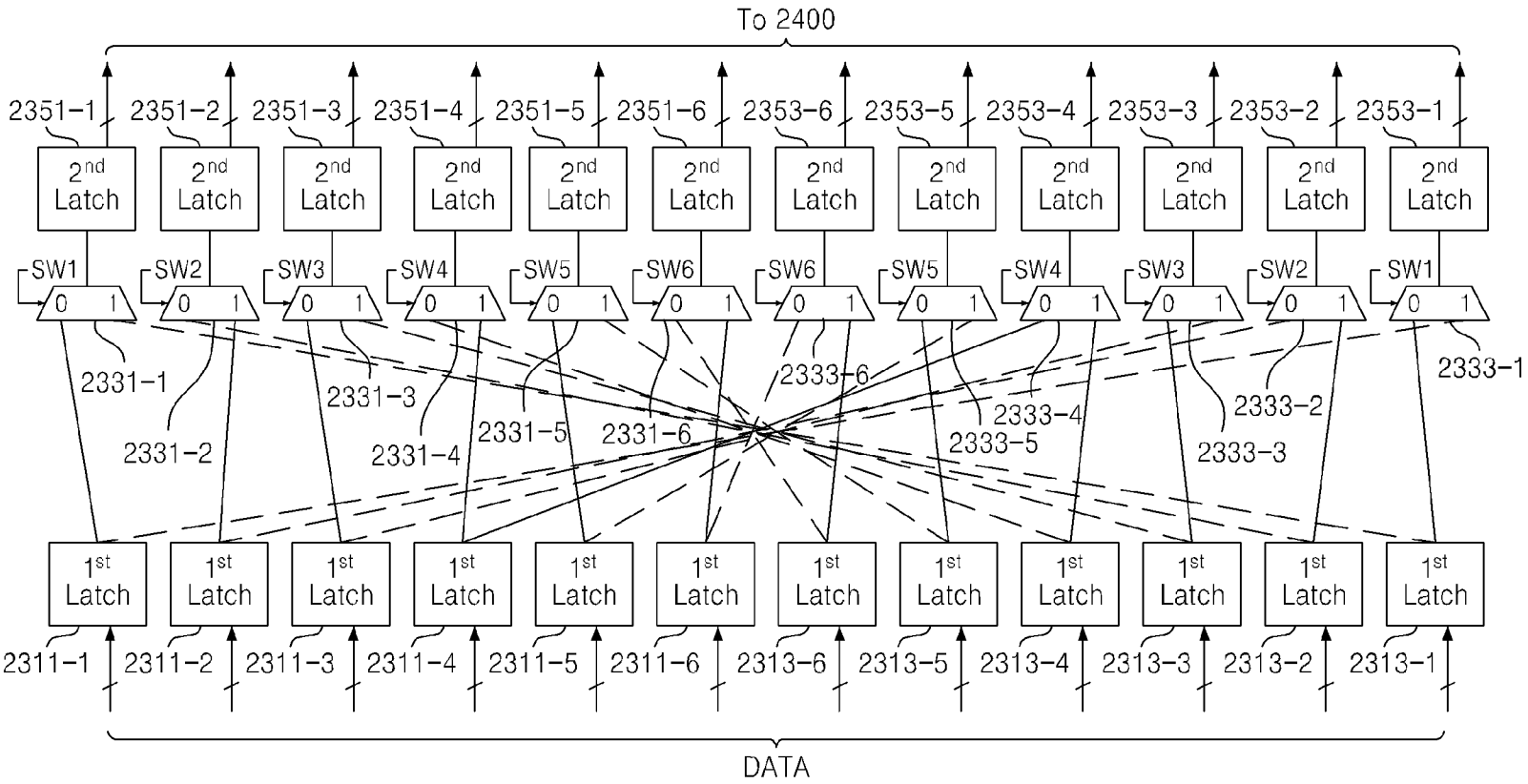
FIG. 18 is a schematic block diagram of a data latch circuit illustrated in FIG. 17.

FIG. 18 is a schematic block diagram of the data latch circuit 2300 illustrated in FIG. 17.

Referring to FIGS. 17 and 18, the data latch circuit 2300 may include a plurality of first data latches 2311-1 through 2311-6 and 2313-1 through 2313-6, a plurality of multiplexers 2331-1 through 2331-6 and 2333-1 through 2333-6, and a plurality of second data latches 2351-1 through 2351-6 and 2353-1 through 2353-6.

Each of the plurality of first data latches 2311-1 through 2311-6 and 2313-1 through 2313-6 may latch a corresponding one of a plurality of data blocks DATA in response to a latch clock signal LCLK.

The plurality of first data latches 2311-1 through 2311-6 and 2313-1 through 2313-6 may form symmetric pairs with each other. For example, two corresponding data latches 2311-1 and 2313-1, 2311-2 and 2313-2, 2311-3 and 2313-3, 2311-4 and 2313-4, 2311-5 and 2313-5, and 2311-6 and 2313-6 among the plurality of first data latches 2311-1 through 2311-6 and 2313-1 through 2313-6 may form a symmetric pair.

Each of the plurality of multiplexer 2331-1 through 2331-6 and 2333-1 through 2333-6 may output one of output signals of the first data latches forming symmetric pairs to one of the plurality of second data latches 2351-1 through 2351-6 and 2353-1 through 2353-6 in response to a corresponding one of the plurality of selection signals SW. For example, as illustrated in FIG. 18, a multiplexer 2331-1 may output one of output signals of first data latches 2311-1 and 2313-1 forming a symmetric pair to a second data latch 2351-1, and a multiplexer 2333-1 may output the other of output signals of the first data latches 2311-1 and 2313-1 forming a symmetric pair to a second data latch 2353-1.

When a selection signal SW1 is at a second level, e.g., a low level, the multiplexer 2331-1 may output an output signal of a first data latch 2311-1 to a second data latch 2351-1, and the multiplexer 2333-1 may output an output signal of a first data latch 2313-1 to a second data latch 2353-1. On the contrary, when the selection signal SW1 is at a first level, e.g., a high level, the multiplexer 2331-1 may output an output signal of the first data latch 2313-1 to the second data latch 2351-1, and the multiplexer 2333-1 may output an output signal of the first data latch 2311-1 to the second data latch 2353-1.

That is, multiplexers 2331-1 and 2333-1 forming a symmetric pair may rearrange and output output signals of the first data latches 2311-1 and 2313-1 forming a symmetric pair to the second data latches 2351-1 and 2353-1 forming a symmetric pair.

Except for corresponding first data latches and corresponding second data latches, a function and an operation of each of multiplexer 2331-2 through 2331-6 are substantially the same as a function and an operation of the multiplexer 2331-1, and a function and an operation of multiplexers 2333-2 through 2333-6 are substantially the same as a function and an operation of the multiplexer 2333-1, so that an explanation for the same part is omitted.

Each of the plurality of second data latches 2351-1 through 2351-6 and 2353-1 through 2353-6 may latch an output signal of a corresponding one of the plurality of multiplexers 2331-1 through 2331-6 and 2333-1 through 2333-6 in response to a clock signal CLK. Accordingly, the plurality of second data latches 2351-1 through 2351-6 and 2353-1 through 2353-6 may rearrange and latch output signals of the plurality of first data latches 2311-1 through 2311-6 and 2313-1 through 2313-6.

The digital-to-analog conversion circuit 2400 converts output signals of the data latch circuit 2300 into analog signals. The multiplexing circuit 2500 may rearrange output signals of the digital-to-analog conversion circuit 2400 in response to the plurality of selection signals SW.

The output buffer circuit 2600 may buffer and output signals of the multiplexing circuit 2500 to pixels of a display panel.

A detailed operation of the digital-to-analog conversion circuit 2400, the multiplexing circuit 2500 and the output buffer circuit 2600 will be explained in detail referring to FIGS. 19 through 31.

Output signals of the output buffer circuit 1600 are supplied to pixels in response to a gating signal output from a gate driver 2050 (as shown in FIG. 32), so that an image may be output to a display. According to an exemplary embodiment, the shift register 2100, the control circuit 2200, the data latch circuit 2300, the digital-to-analog conversion circuit 2400, the multiplexing circuit 2500 and the output buffer circuit 2600 may be embodied in one chip or, respectively, in separate independent chips.

Figure 19:
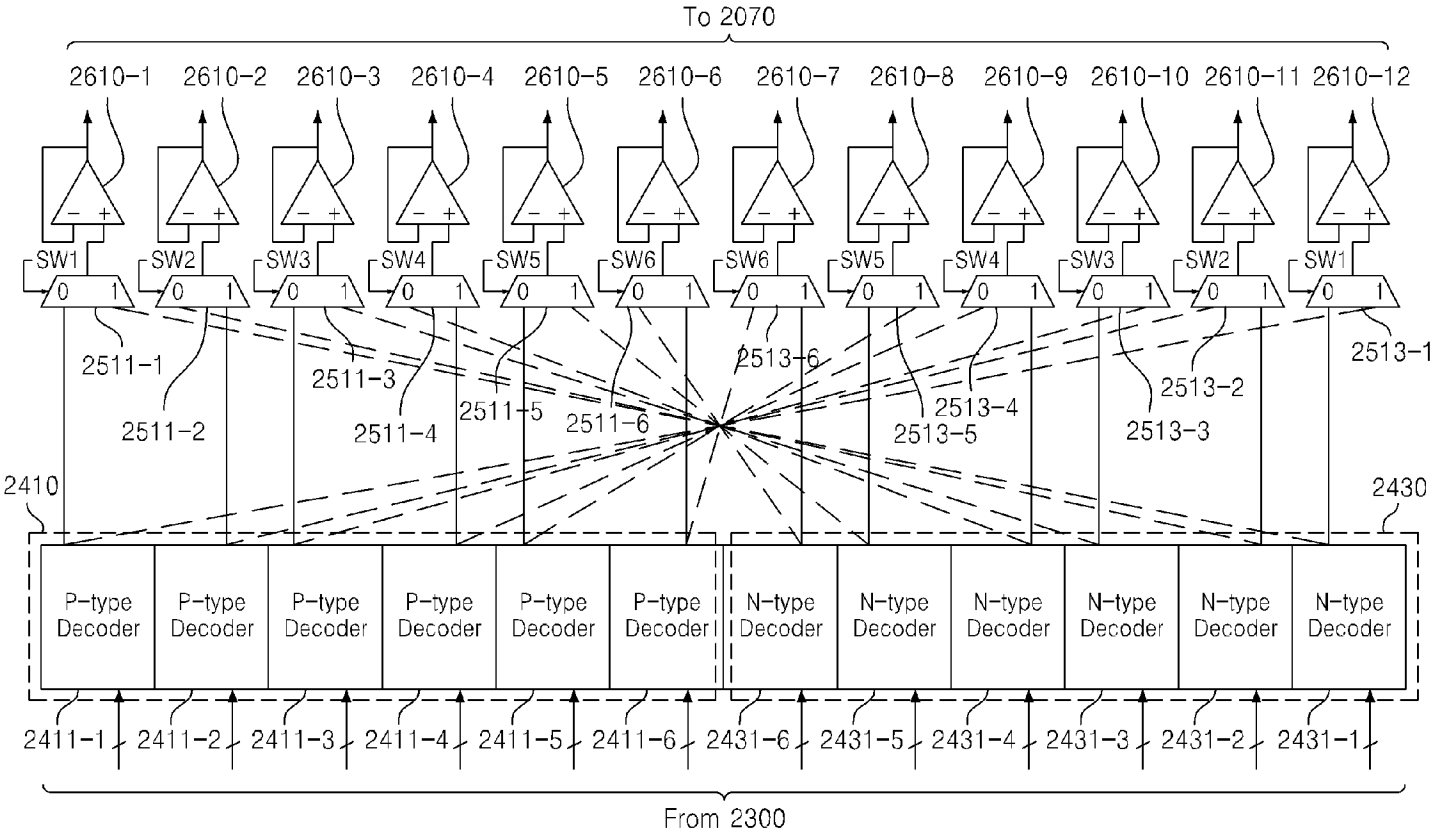
FIG. 19 is a block diagram of a digital-to-analog conversion circuit, a multiplexing circuit, and an output buffer circuit illustrated in FIG. 17.

FIG. 19 is a block diagram of an exemplary embodiment of the digital-to-analog conversion circuit 2400, the multiplexing circuit 2500, and the output buffer circuit 2600 illustrated in FIG. 17. Referring to FIGS. 17 and 19, the digital-to-analog conversion circuit 2400 may include a plurality of first type decoders 2411-1 through 2411-6 formed in a first region 2410, e.g., a plurality of P-type decoders or P-type digital-to-analog converters, and a plurality of second type decoders 2431-1 through 2431-6 formed in a second region 2430, e.g., a plurality of N-type decoders or N-type digital-to-analog converters.

The plurality of first type decoders 2411-1 through 2411-6 and the plurality of second type decoders 2431-1 through 2431-6 may form symmetric pairs with each other. For example, two corresponding decoders 2411-1 and 2431-1, 2411-2 and 2431-2, 2411-3 and 2431-3, 2411-4 and 2431-4, 2411-5 and 2431-5, and 2411-6 and 2431-6 may form respective symmetric pairs.

Each of the plurality of first type decoders 2411-1 through 2411-6 may convert a corresponding one of output signals of the data latch circuit 2300 into a positive analog signal, and each of the plurality of second type decoders 2431-1 through 2431-6 may convert a corresponding one of output signals of the data latch circuit 2300 into a negative analog signal.

For convenience of explanation in the present general inventive concept, polarity of analog signals is referred to as positive and negative, however, the present general inventive concept is not restricted thereto. In the other words, positive in the present general inventive concept may mean a voltage higher than a reference voltage, and negative may mean a voltage lower than the reference voltage.

According to an exemplary embodiment, each of the plurality of first type decoders 2411-1 through 2411-6 may be embodied in P-type transistors formed in an N-type well. Each of the plurality of second type decoders 2431-1 through 2431-6 may be embodied in N-type transistors formed in a P-type well. According to an exemplary embodiment, a first region 2410 and a second region 2430 may be electrically divided.

The multiplexing circuit 2500 may include a plurality of multiplexers 2511-1 through 2511-6 and 2513-1 through 2513-6.

Each of the plurality of multiplexers 2511-1 through 2511-6 and 2513-1 through 2513-6 may output one of an output signal of a first type decoder and an output signal of a second type decoder which form a symmetric pair to a corresponding one of a plurality of buffers 2610-1 through 2610-12, in response to a corresponding one of a plurality of selection signals (SW). For example, as illustrated in FIG. 19, a multiplexer 2511-1 may output one of an output signal of a first type decoder 2411-1 and an output signal of a second type decoder 2431-1 which form a symmetric pair to a buffer 2610-1 in response to a selection signal SW1.

In response to the selection signal SW1, a multiplexer 2513-1 may output the other of an output signal of the first type decoder 2411-1 and an output signal of the second type decoder 2431-1 which form a symmetric pair to a buffer 2610-12.

When the selection signal SW1 is at a first level, e.g., a high level, the multiplexer 2511-1 may output an output signal of the second type decoder 2431-1 to the buffer 2610-1, and the multiplexer 2513-1 may output an output signal of the first type decoder 2411-1 to the buffer 2610-12.

On the contrary, when the selection signal SW1 is at a second level, e.g., a low level, the multiplexer 2511-1 may output an output signal of the first type decoder 2411-1 to the buffer 2610-1, and the multiplexer 2513-1 may output an output signal of the second type decoder 2431-1 to the buffer 2610-12.

That is, the multiplexers 2511-1 and 2513-1 forming a symmetric pair may rearrange and output signals of decoders 2411-1 and 2431-1 forming a symmetric pair to buffers 2610-1 and 2610-12 forming a symmetric pair.

Except for corresponding first type decoders, corresponding second type decoders and corresponding buffers, a function and an operation of each of multiplexers 2511-2 through 2511-6 are substantially the same as a function and an operation of the multiplexer 2511-1, and a function and an operation of each of multiplexers 2513-2 through 2513-6 are substantially the same as a function and an operation of the multiplexer 2513-1, so that an explanation for the same part is omitted.

The output buffer circuit 2600 may include a plurality of buffers 2610-1 through 2610-12. Each of the plurality of buffers 2610-1 through 2610-12 may buffer and output an output signal of a corresponding one of the plurality of multiplexers 2511-1 through 2511-6 and 2513-1 through 2513-6 to a display panel 2070 (as shown in FIG. 32).

According to an exemplary embodiment, each of the plurality of buffers 2610-1 through 2610-12 may be a unit gain buffer. For example, each of the plurality of buffers 2610-1 through 2610-12 may be embodied in a rail to rail buffer.

Figure 20:
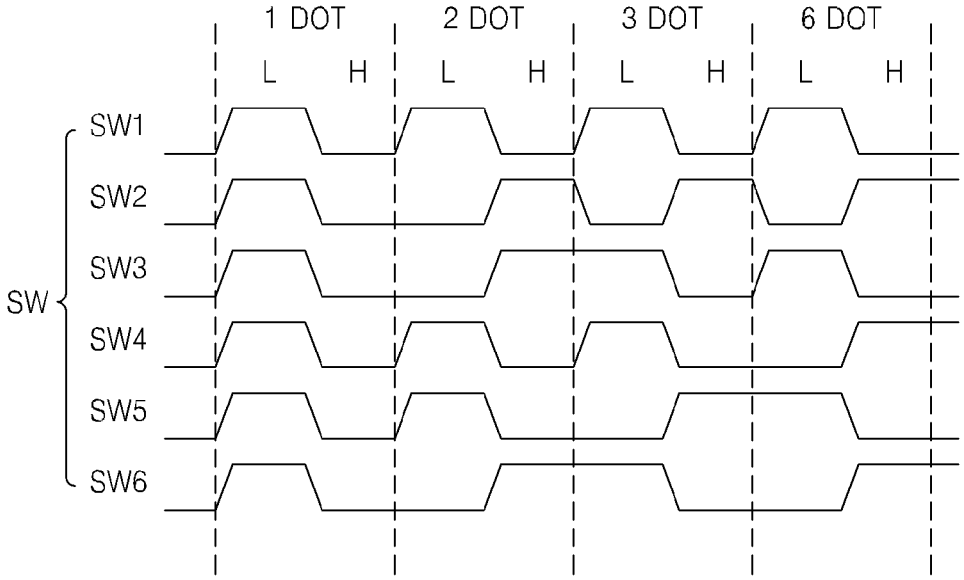
FIG. 20 is a timing diagram illustrating an operation of the multiplexing circuit illustrated in FIG. 19.

FIG. 20 is a timing diagram for explaining an operation of the multiplexing circuit illustrated in FIG. 19. Referring to FIGS. 17, 19 and 20, the control circuit 2200 may output a plurality of selection signals SW in response to a polarity control signal POL and an inversion mode control signal DOT as illustrated in FIG. 20.

A timing diagram illustrated in FIG. 20 is no more than exemplification. That is, the present general inventive concept is not restricted to the timing diagram illustrated in FIG. 20.

Figure 21:
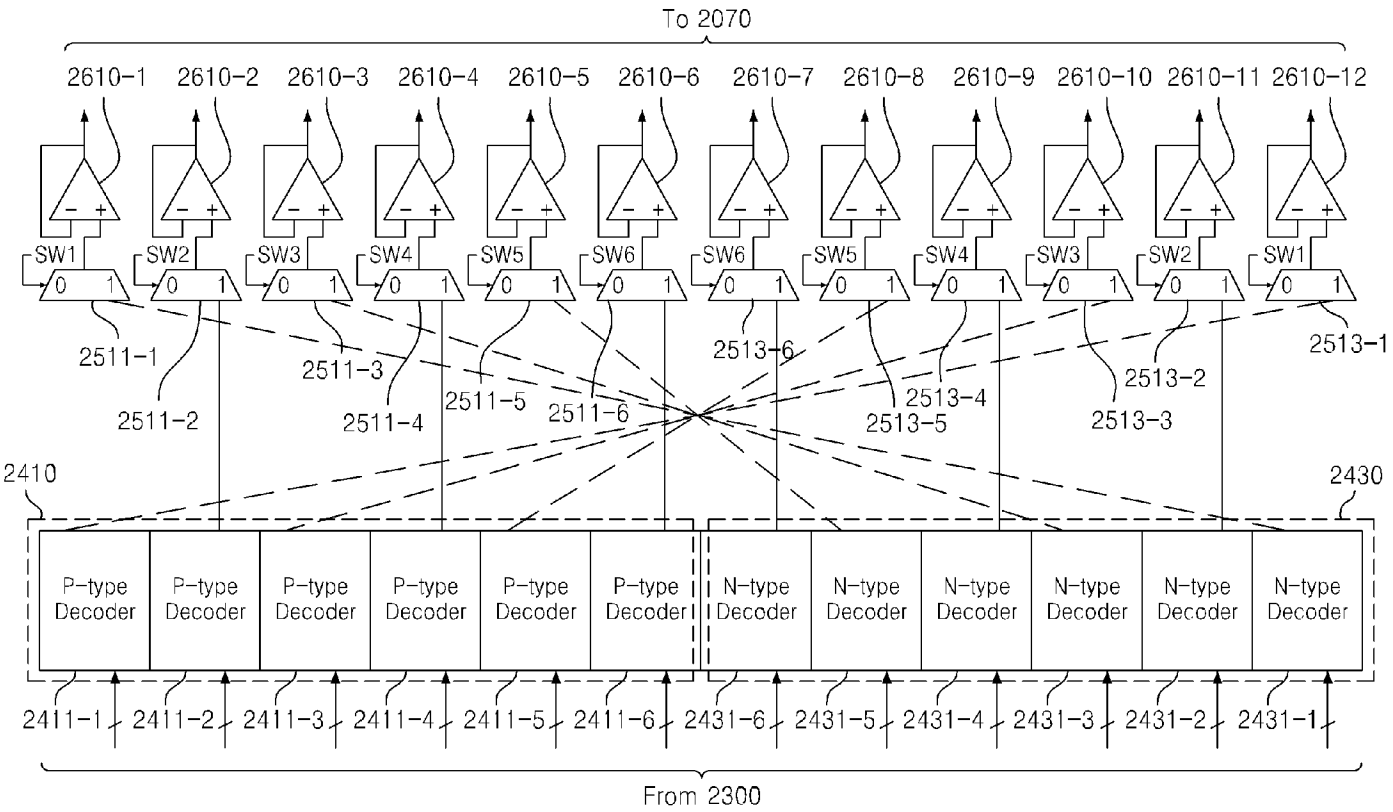
FIG. 21 is a block diagram illustrating an operation of the multiplexing circuit illustrated in FIG. 19 when an inversion mode control signal indicates a one-DOT inversion mode and a polarity control signal is at a low level.

FIG. 21 is a block diagram for explaining an operation of the multiplexing circuit illustrated in FIG. 19 when an inversion mode control signal indicates a one-DOT inversion mode and a polarity control signal is at a low level.

Referring to FIGS. 17, and 19 through 21, when an inversion mode control signal indicates a one-DOT inversion mode and a polarity control signal is at a low level, selection signals SW1 through SW6 may be all at a high level as illustrated in FIG. 20.

Accordingly, as illustrated in FIG. 21, each of the multiplexers 2511-1 through 2511-6 and 2513-1 through 2513-6 may output an output signal of a decoder corresponding to a high level among the plurality of decoders 2411-1 through 2411-6 and 2431-1 through 2431-6.

For example, the multiplexer 2511-1 may output an output signal of the second type decoder 2431-1 to the buffer 2610-1, and the multiplexer 2513-1 may output an output signal of the first type decoder 2411-1 to the buffer 2610-12.

When polarity of output signals of the first type decoders 2411-1 through 2411-6 is described as '+' and polarity of output signals of the second type decoders 2431-1 through 2431-6 is described as '−', polarity of output signals of the plurality of multiplexers 2511-1 through 2511-6 and 2513-1 through 2513-6 may be '−+−+−+−+−+−+'.

Figure 22:
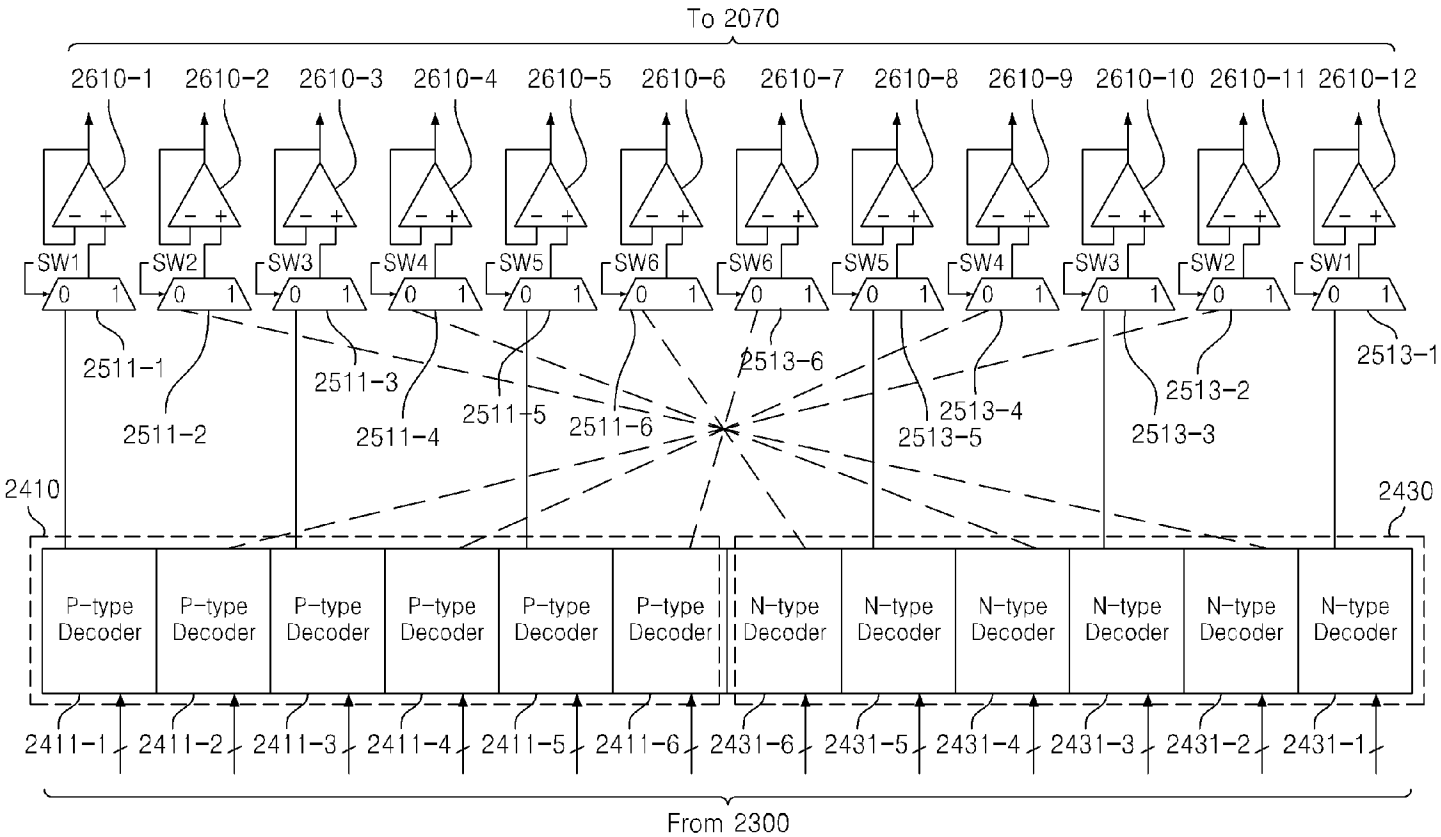
FIG. 22 is a block diagram illustrating an operation of the multiplexing circuit illustrated in FIG. 19 when an inversion mode control signal indicates the one-DOT inversion mode and a polarity control signal is at a high level.

FIG. 22 is a block diagram for explaining an operation of the multiplexing circuit illustrated in FIG. 19 when an inversion mode control signal indicates a one-DOT inversion mode and a polarity control signal is at a high level.

Referring to FIGS. 17, 19, 20 and 22, when an inversion mode control signal indicates the one-DOT inversion mode and a polarity control signal is at a high level, selection signals SW1 through SW6 may be all at a low level as illustrated in FIG. 20.

Accordingly, as illustrated in FIG. 22, each of multiplexers 2511-1 through 2511-6 and 2513-1 through 2513-6 may output an output signal of a decoder corresponding to a low level among the plurality of decoders 2411-1 through 2411-6 and 2431-1 through 2431-6.

For example, the multiplexer 2511-1 may output an output signal of the first type decoder 2411-1 to the buffer 2610-1, and the multiplexer 2513-1 may output an output signal of the second type decoder 2431-1 to the buffer 2610-12.

Polarity of output signals of the plurality of multiplexers 2511-1 through 2511-6 and 2513-1 through 2513-6 may be '+−+−+−+−+−+−'.

Figure 23:
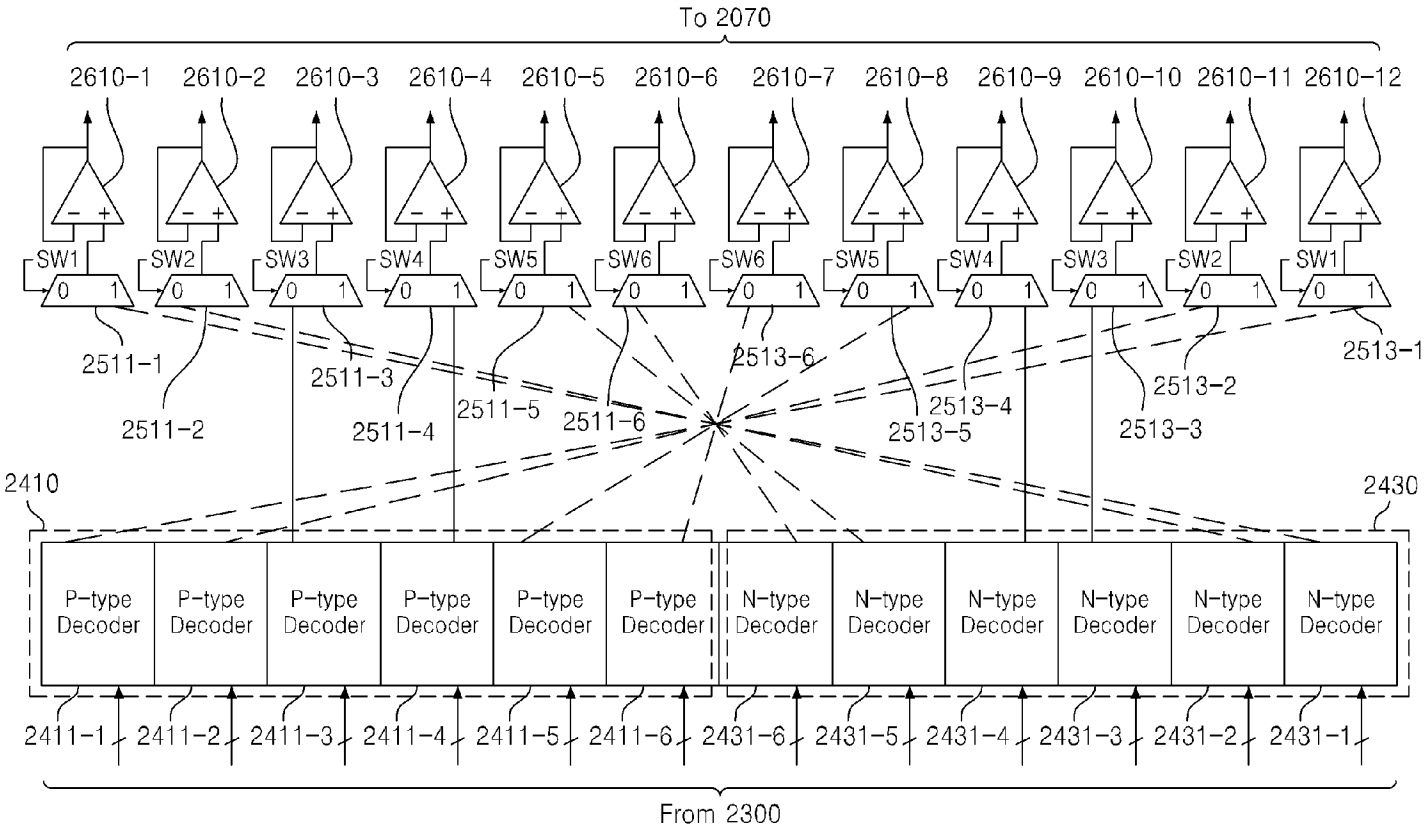
FIG. 23 is a block diagram illustrating an operation of the multiplexing circuit illustrated in FIG. 19 when an inversion mode control signal indicates a two-DOT inversion mode and a polarity control signal is at a low level.

FIG. 23 is a block diagram for explaining an operation of the multiplexing circuit illustrated in FIG. 19 when an inversion mode control signal indicates a two-DOT inversion mode and a polarity control signal is at a low level.

Referring to FIGS. 17, 19, 20 and 23, when an inversion mode control signal indicates the two-DOT inversion mode and a polarity control signal is at a low level, selection signals SW1, SW4 and SW5 are at a high level and selection signals SW2, SW3 and SW6 are at a low level as illustrated in FIG. 20.

Accordingly, as illustrated in FIG. 23, each of multiplexers 2511-1, 2511-4, 2511-5, 2513-1, 2513-4 and 2513-5 may output an output signal of a decoder corresponding to a high level among the plurality of decoders 2411-1 through 2411-6 and 2431-1 through 2431-6. Besides, as illustrated in FIG. 23, each of multiplexers 2511-2, 2511-3, 2511-6, 2513-2, 2513-3 and 2513-6 may output an output signal of a decoder corresponding to a low level among the plurality of decoders 2411-1 through 2411-6 and 2431-1 through 2431-6.

Polarity of output signals of the plurality of multiplexers 2511-1 through 2511-6 and 2513-1 through 2513-6 may be '−−++−−++−−++'.

Figure 24:
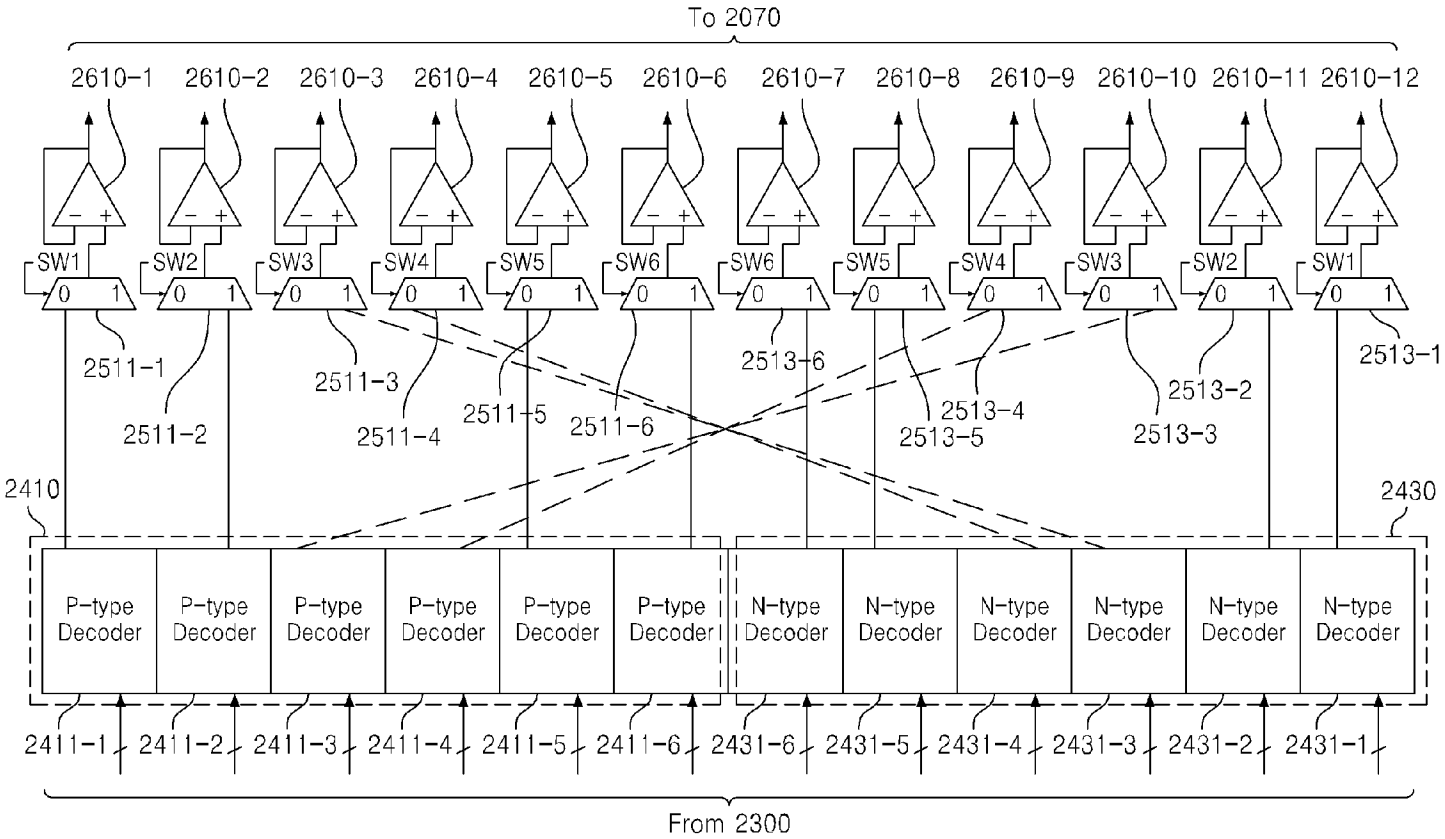
FIG. 24 is a block diagram illustrating an operation of the multiplexing circuit illustrated in FIG. 19 when an inversion mode control signal indicates the two-DOT inversion mode and a polarity control signal is at a high level.

FIG. 24 is a block diagram for explaining an operation of the multiplexing circuit illustrated in FIG. 19 when an inversion mode control signal indicates a two-DOT inversion mode and a polarity control signal is at a high level.

Referring to FIGS. 17, 19, 20 and 24, when an inversion mode control signal indicates the two-DOT inversion mode and a polarity control signal is at a high level, selection signals SW2, SW3 and SW6 are at a high level and selection signals SW1, SW4 and SW5 are at a low level as illustrated in FIG. 20.

Accordingly, as illustrated in FIG. 24, each of multiplexers 2511-2, 2511-3, 2511-6, 2513-2, 2513-3 and 2513-6 may output an output signal of a decoder corresponding to a high level among the plurality of decoders 2411-1 through 2411-6 and 2431-1 through 2431-6.

In addition, as illustrated in FIG. 24, each of multiplexers 2511-1, 2511-4, 2511-5, 2513-1, 2513-4 and 2513-5 may output an output signal of a decoder corresponding to a low level among the plurality of decoders 2411-1 through 2411-6 and 2431-1 through 2431-6.

Polarity of output signals of the plurality of multiplexers 2511-1 through 2511-6 and 2513-1 through 2513-6 may be '++−−++−−++−−'.

Figure 25:
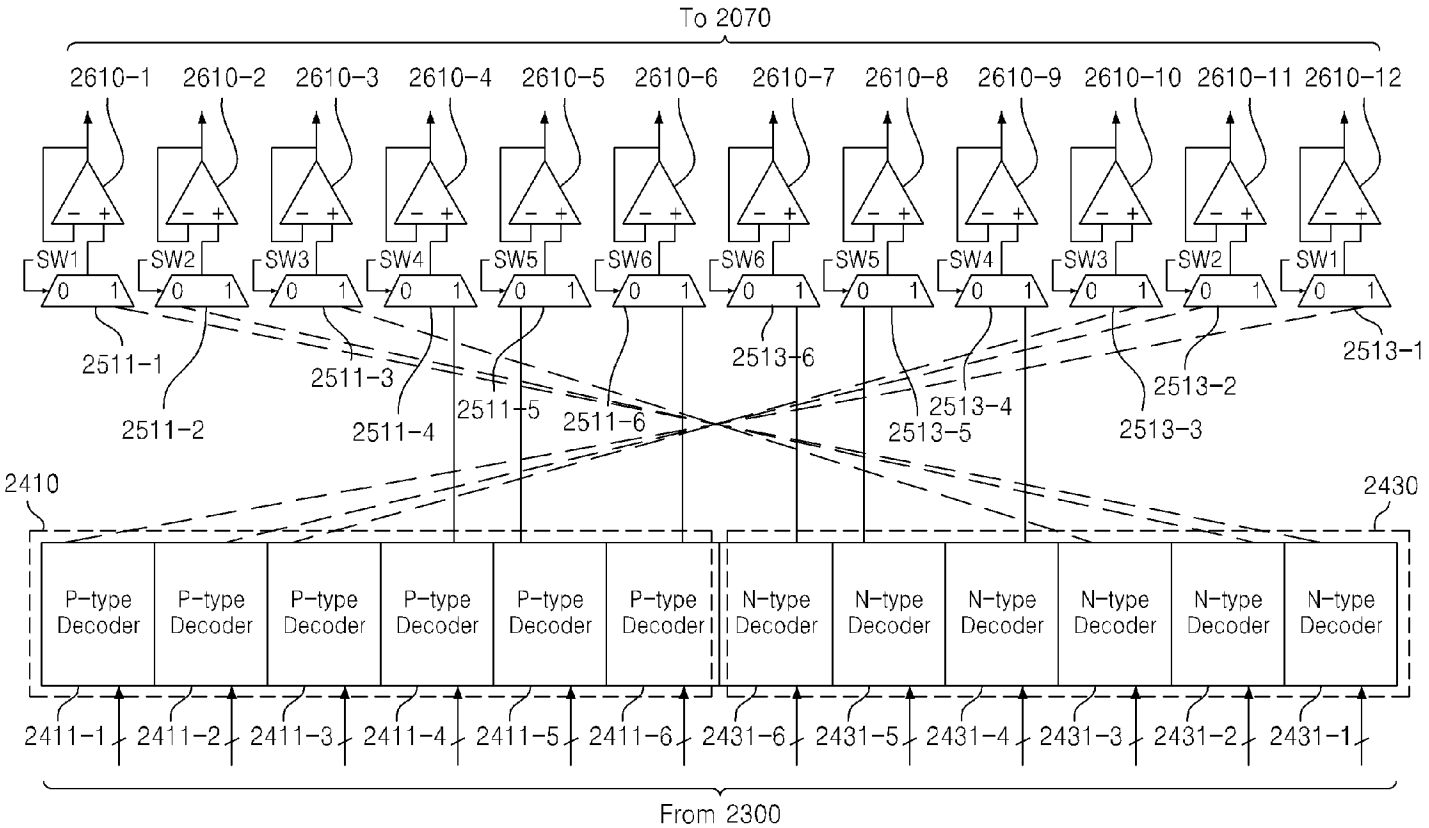
FIG. 25 is a block diagram illustrating an operation of the multiplexing circuit illustrated in FIG. 19 when an inversion mode control signal indicates a three-DOT inversion mode and a polarity control signal is at a low level.

FIG. 25 is a block diagram for explaining an operation of the multiplexing circuit illustrated in FIG. 19 when an inversion mode control signal indicates a three-DOT inversion mode and a polarity control signal is at a low level.

Referring to FIGS. 17, 19, 20 and 25, when an inversion mode control signal indicates the three-DOT inversion mode and a polarity control signal is at a low level, selection signals SW1, SW3, SW4 and SW6 may be at a high level and selection signals SW2 and SW5 may be at a low level as illustrated in FIG. 20.

Accordingly, as illustrated in FIG. 25, each of multiplexers 2511-1, 2511-3, 2511-4, 2511-6, 2513-1, 2513-3, 2513-4 and 2513-6 may output an output signal of a decoder corresponding to a high level among the plurality of decoders 2411-1 through 2411-6 and 2431-1 through 2431-6.

Besides, as illustrated in FIG. 25, each of multiplexers 2511-2, 2511-5, 2513-2 and 2513-5 may output an output signal of a decoder corresponding to a low level among the plurality of decoders 2411-1 through 2411-6 and 2431-1 through 2431-6.

Polarity of output signals of the plurality of multiplexers 2511-1 through 2511-6 and 2513-1 through 2513-6 may be '−−−+++−−−+++'.

Figure 26:
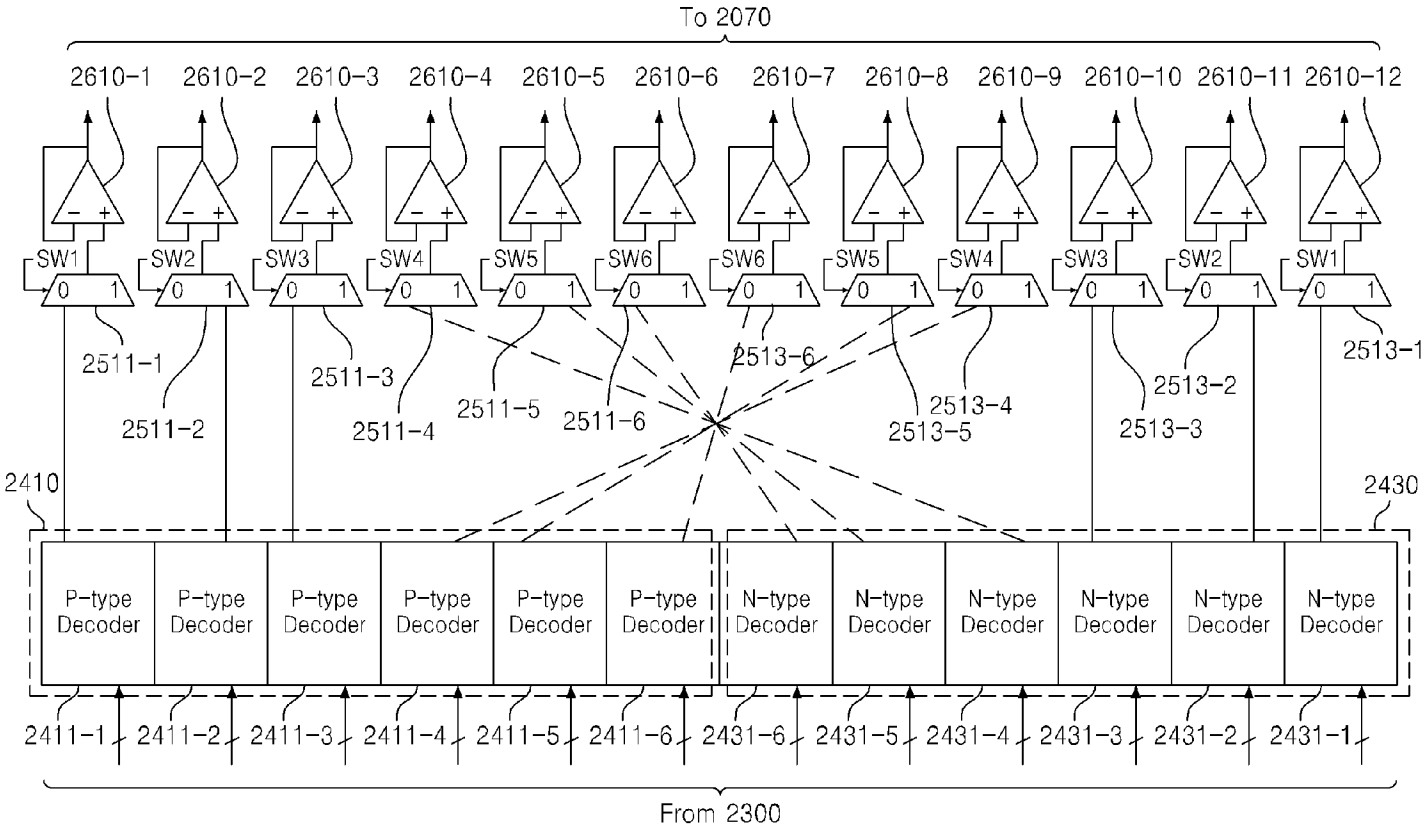
FIG. 26 is a block diagram illustrating an operation of the multiplexing circuit illustrated in FIG. 19 when an inversion mode control signal indicates the three-DOT inversion mode and a polarity control signal is at a high level.

FIG. 26 is a block diagram for explaining an operation of the multiplexing circuit illustrated in FIG. 19 when an inversion mode control signal indicates a three-DOT inversion mode and a polarity control signal is at a high level.

Referring to FIGS. 17, 19, 20 and 26, selection signals SW2 and SW5 may be at a high level and selection signals SW1, SW3, SW4 and SW6 may be at a low level as illustrated in FIG. 20 when an inversion mode control signal indicates the three-DOT inversion mode and a polarity control signal is at a high level.

Accordingly, as illustrated in FIG. 26, each of multiplexers 2511-2, 2511-5, 2513-2 and 2513-5 may output an output signal of a decoder corresponding to a high level among the plurality of decoders 2411-1 through 2411-6 and 2431-1 through 2431-6.

In addition, as illustrated in FIG. 26, each of multiplexers 2511-1, 2511-3, 2511-4, 2511-6, 2513-1, 2513-3, 2513-4 and 2513-6 may output an output signal of a decoder corresponding to a low level among the plurality of decoders 2411-1 through 2411-6 and 2431-1 through 2431-6.

Polarity of output signals of the plurality of multiplexers 2511-1 through 2511-6 and 2513-1 through 2513-6 may be '+++−−−+++−−−'.

Figure 27:
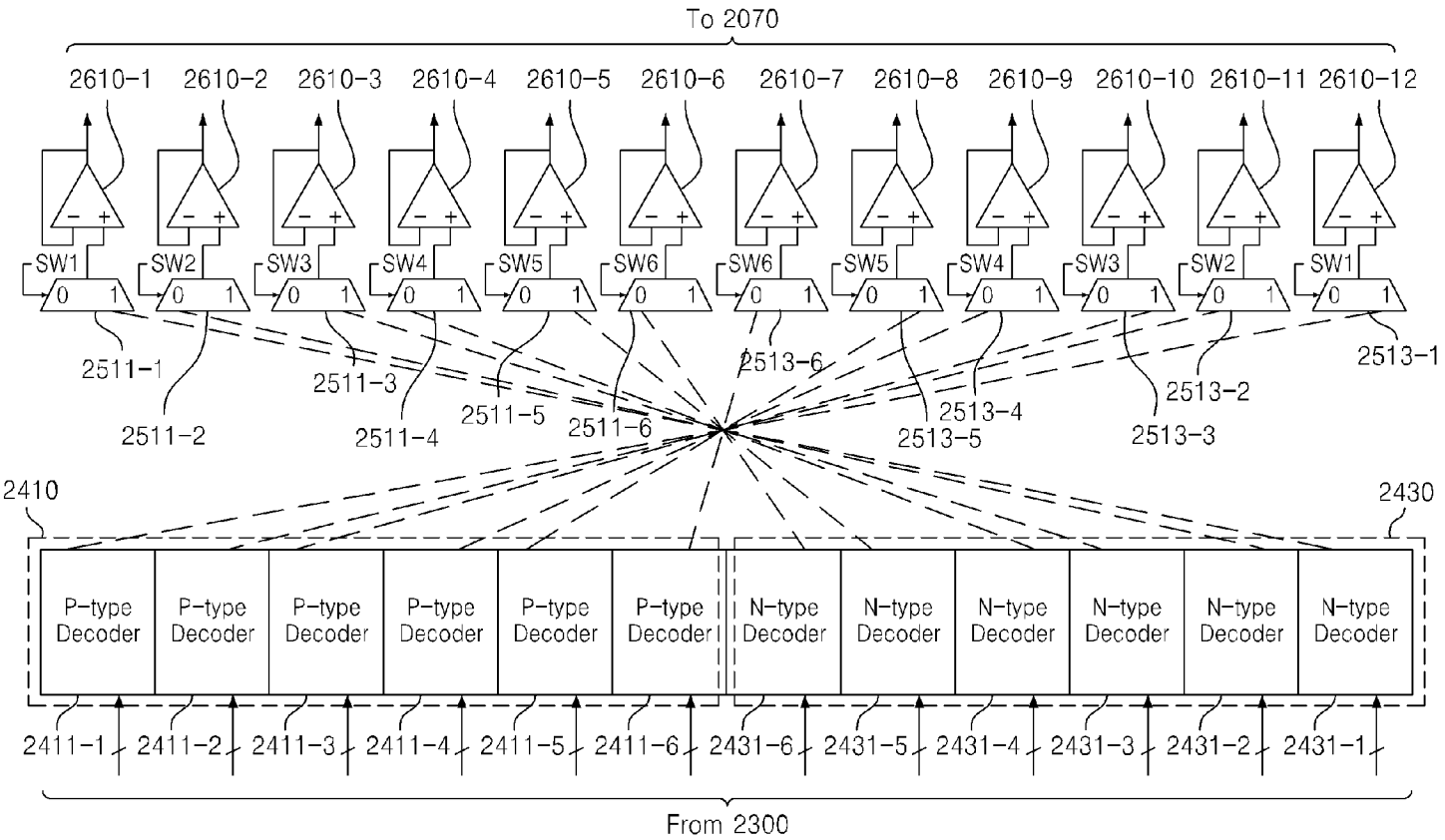
FIG. 27 is a block diagram illustrating an operation of the multiplexing circuit illustrated in FIG. 19 when an inversion mode control signal indicates a six-DOT inversion mode and a polarity control signal is at a low level.

FIG. 27 is a block diagram for explaining an operation of the multiplexing circuit illustrated in FIG. 19 when an inversion mode control signal indicates a six-DOT inversion mode and a polarity control signal is at a low level.

Referring to FIGS. 17, 19, 20 and 27, when an inversion mode control signal indicates the six-DOT inversion mode and a polarity control signal is at a low level, selection signals SW1, SW3 and SW5 may be at a high level and selection signals SW2, SW4 and SW6 may be at a low level as illustrated in FIG. 20.

Accordingly, as illustrated in FIG. 27, each of multiplexers 2511-1, 2511-3, 2511-5, 2513-1, 2513-3 and 2513-5 may output an output signal of a decoder corresponding to a high level among the plurality of decoders 2411-1 through 2411-6 and 2431-1 through 2431-6.

Moreover, each of multiplexers 2511-2, 2511-4, 2511-6, 2513-2, 2513-4 and 2513-6 may output an output signal of a decoder corresponding to a low level among the plurality of decoders 2411-1 through 2411-6 and 2431-1 through 2431-6 as illustrated in FIG. 27.

Polarity of output signals of the plurality of multiplexers 2511-1 through 2511-6 and 2513-1 through 2513-6 may be '−−−−−−++++++'.

Figure 28:
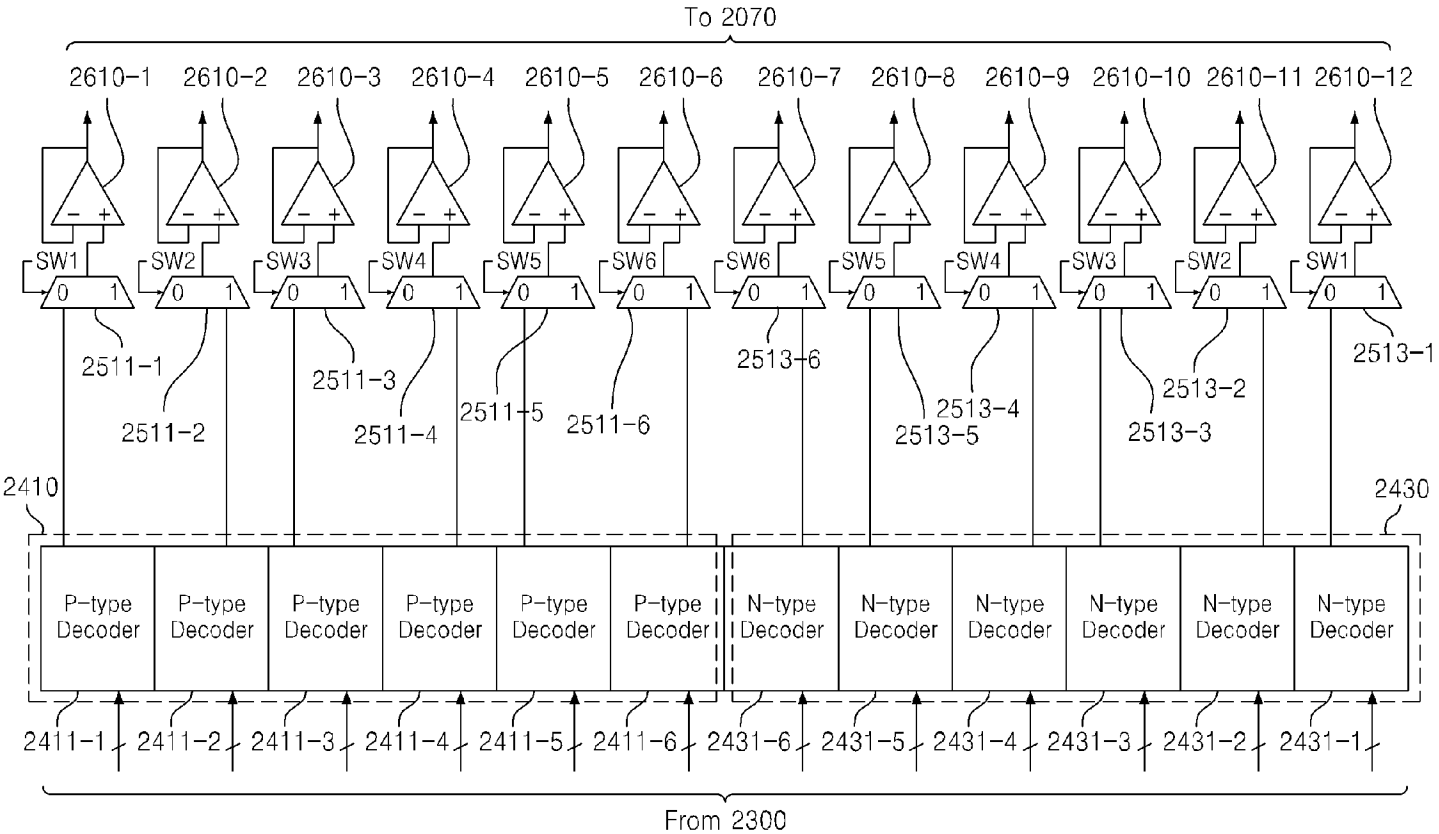
FIG. 28 is a block diagram illustrating an operation of the multiplexing circuit illustrated in FIG. 19 when an inversion mode control signal indicates the six-DOT inversion mode and a polarity control signal is at a high level.

FIG. 28 is a block diagram for explaining an operation of the multiplexing circuit illustrated in FIG. 19 when an inversion mode control signal indicates a six-DOT inversion mode and a polarity control signal is at a high level.

Referring to FIGS. 17, 19, 20 and 28, when an inversion mode control signal indicates a six-DOT inversion mode and a polarity control signal is at a high level, selection signals SW2, SW4, and SW6 may be at a high level and selection signals SW1, SW3, and SW5 may be at a low level as illustrated in FIG. 20.

Accordingly, as illustrated in FIG. 28, each of multiplexers 2511-2, 2511-4, 2511-6, 2513-2, 2513-4 and 2513-6 may output an output signal of a decoder corresponding to a high level among the plurality of decoders 2411-1 through 2411-6 and 2431-1 through 2431-6.

In addition, as illustrated in FIG. 28, each of multiplexers 2511-1, 2511-3, 2511-5, 2513-1, 2513-3 and 2513-5 may output an output signal of a decoder corresponding to a low level among the plurality of decoders 2411-1 through 2411-6 and 2431-1 through 2431-6.

Polarity of output signals of the plurality of multiplexers 2511-1 through 2511-6 and 2513-1 through 2513-6 may be '++++++------'.

Figure 29:
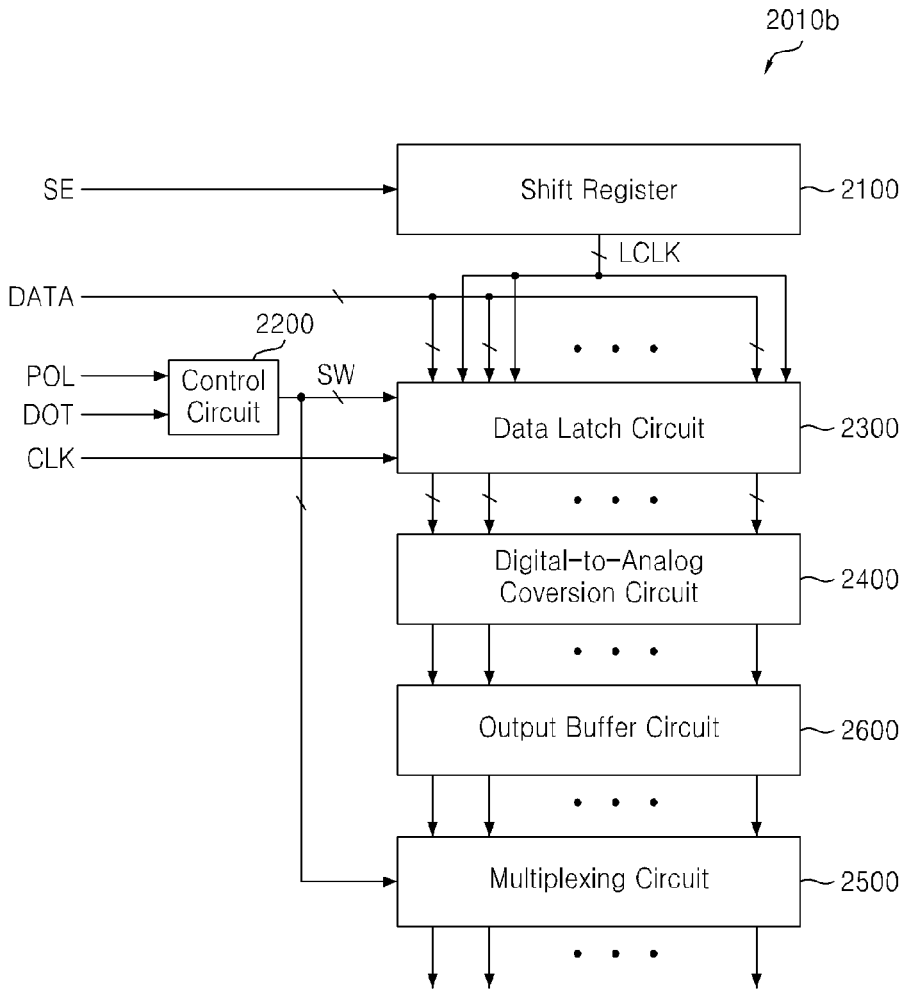
FIG. 29 is a schematic block diagram of the source driver according to still another exemplary embodiment of the present general inventive concept.

FIG. 29 is a schematic block diagram of a source driver according to still another exemplary embodiment of the present general inventive concept. Referring to FIG. 29, a source driver 2010*b* includes the shift register 2100, the control circuit 2200, the data latch circuit 2300, the digital-to-analog conversion circuit 2400, the output buffer circuit 2600 and the multiplexing circuit 2500.

Except for connection between the output buffer circuit 2600 and the multiplexing circuit 2500, a function and an operation of the source driver 2010*b* of FIG. 29 are substantially the same as a function and an operation of the source driver 2010*a* of FIG. 17, therefore an explanation for the same parts is omitted.

The output buffer circuit 2600 may buffer and output output signals of the digital-to-analog conversion circuit 2400 to the multiplexing circuit 2500.

The multiplexing circuit 2500 may rearrange and output output signals of the output buffer circuit 2600 to a display panel 2070 (as shown in FIG. 32) in response to a plurality of selection signals SW.

Figure 30:
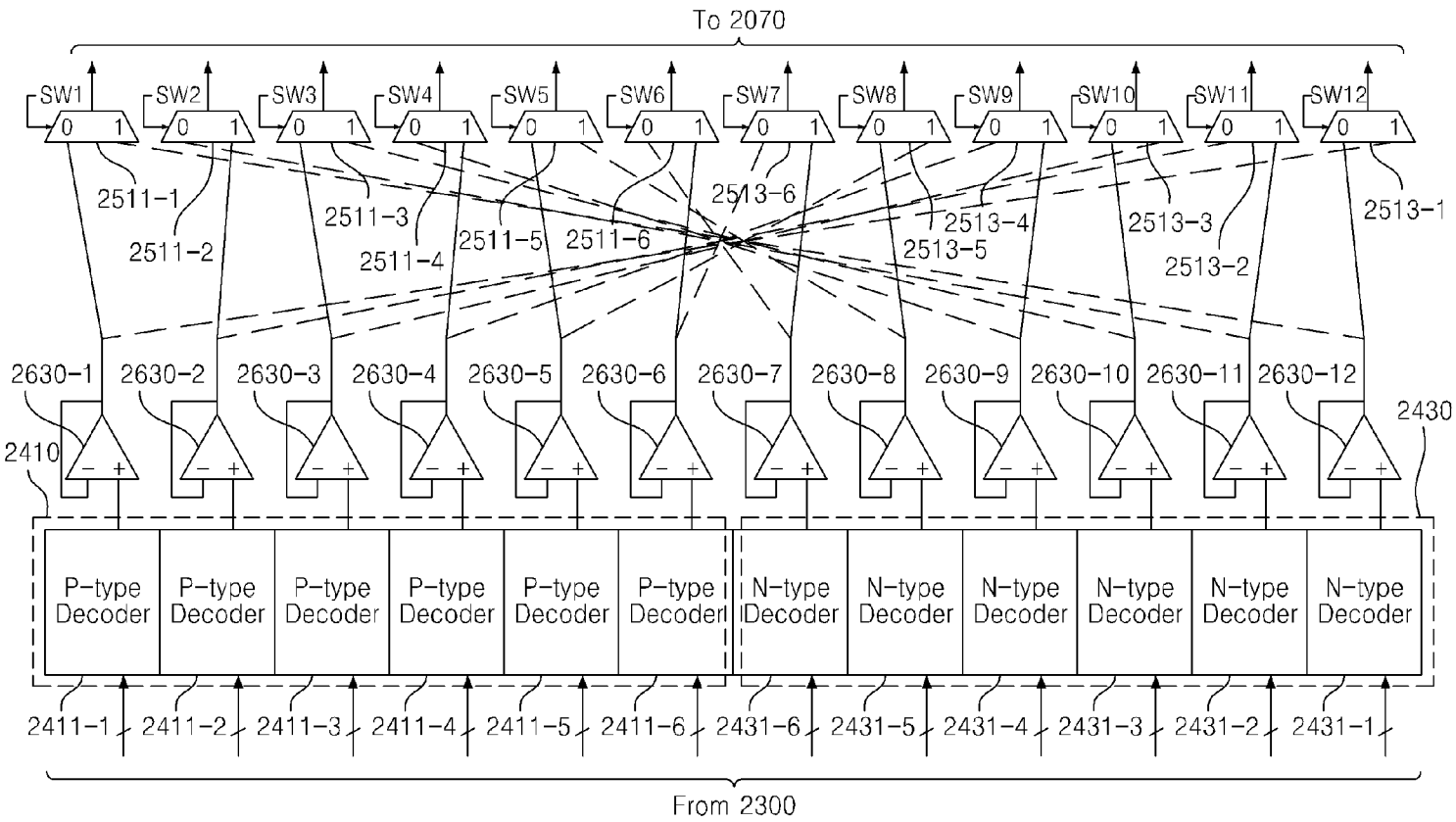
FIG. 30 is a block diagram of a digital-to-analog conversion circuit, a multiplexing circuit and an output buffer circuit illustrated in FIG. 29.

FIG. 30 is a block diagram of a digital-to-analog conversion circuit, a multiplexing circuit and an output buffer circuit illustrated in FIG. 29.

Referring to FIGS. 29 and 30, the digital-to-analog conversion circuit 2400 may include a plurality of first type decoders 2411-1 through 2411-6 equipped in a first region 2410 and a plurality of second type decoders 2431-1 through 2431-6 equipped in a second region 2430.

The output buffer circuit 2600 may include a plurality of buffers 2630-1 through 2630-12. Each of the plurality of buffers 2630-1 through 2630-12 may buffer and output an output signal of a corresponding one of the plurality of decoders 2411-1 through 2411-6 and 2431-1 through 2431-6 to a corresponding one of the plurality of multiplexers 2511-1 through 2511-6 and 2513-1 through 2513-6.

The plurality of buffers 2630-1 through 2630-12 may form symmetric pairs. For example, buffers 2630-1 and 2630-12, buffers 2630-2 and 2630-11, buffers 2630-3 and 2630-10, buffers 2630-4 and 2630-9, buffers 2630-5 and 2630-8, and buffers 2630-6 and 2630-7 may form symmetric pairs, respectively.

According to an exemplary embodiment, each of the plurality of buffers 2630-1 through 2630-12 may be a unit gain buffer. For example, each of the plurality of buffers 2630-1 through 2630-12 may be embodied in a split rail buffer.

The multiplexing circuit 2500 may include the plurality of multiplexers 2511-1 through 2511-6 and 2513-1 through 2513-6. Each of the plurality of multiplexers 2511-1 through 2511-6 and 2513-1 through 2513-6 may output one of output signals of buffers 2630-1 through 2630-12 forming a symmetric pair to a display panel 2070 (as shown in FIG. 32) in response to a corresponding one of the plurality of selection signals SW.

Except that the plurality of buffers 2630-1 through 2630-12 are connected to receive an input from the plurality of decoders 2411-1 through 2411-6 and 2431-1 through 2431-6 instead of the plurality of multiplexers 2511-1 through 2511-6 and 2513-1 through 2513-6, a function and an operation of the plurality of decoders 2411-1 through 2411-6 and 2431-1 through 2431-6 illustrated in FIG. 29 are substantially the same as a function and an operation of the plurality of decoders 2411-1 through 2411-6 and 2431-1 through 2431-6 illustrated in FIG. 19, and a function and an operation of the plurality of multiplexers 2511-1 through 2511-6 and 2513-1 through 2513-6 illustrated in FIG. 29 are substantially the same as a function and an operation of the plurality of multiplexers 2511-1 through 2511-6 and 2513-1 through 2513-6 illustrated in FIG. 19. Accordingly, an explanation for the same parts is omitted.

Figure 31:
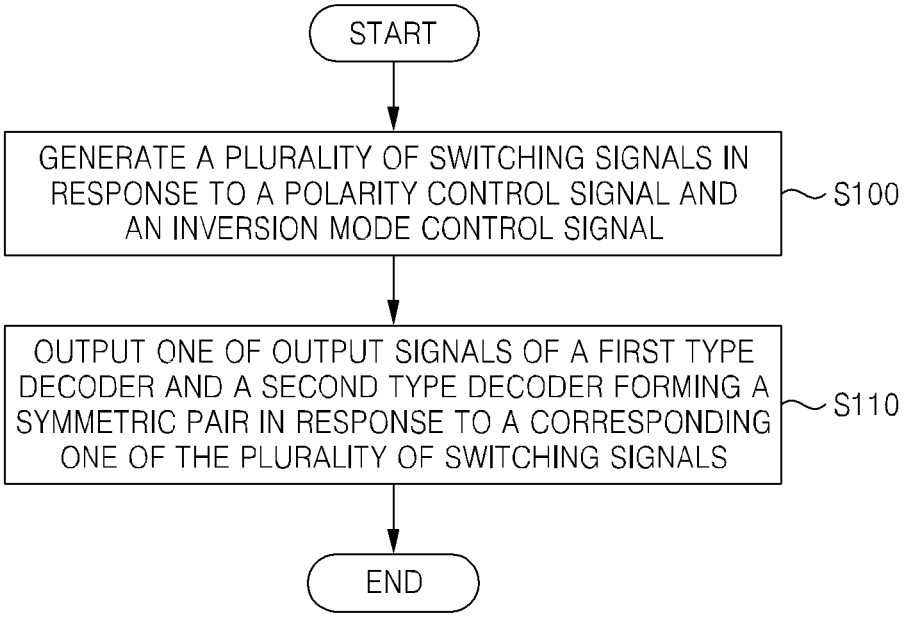
FIG. 31 is a flowchart illustrating an operation of the multiplexing circuit illustrated in FIG. 17.

FIG. 31 is a flowchart for explaining an operation of the multiplexing circuit illustrated in FIG. 17. Referring to FIGS. 17 through 31, the control circuit 2200 may output the plurality of selection signals SW based on a polarity control signal POL and an inversion mode control signal DOT at operation S100.

Each of the plurality of multiplexers 2511-1 through 2511-6 and 2513-1 through 2513-6 may output one of output signals of a first type decoder and a second type decoder which form a symmetric pair in response to a corresponding one of the plurality of selection signals SW at operation S110.

FIG. 32 is a schematic block diagram of a display device including the source driver illustrated in FIG. 1, 17 or 29. Referring to FIGS. 1, 17, 29 and 32, a display device 2000 may include a source driver 1010 or 2010, an interface 2030, a gate driver 2050 and a display panel 2070.

The interface 2030 may receive image data to display through the display panel 2070 from a host, output a start signal SE, data blocks DATA, a polarity control signal POL, an inversion mode control signal DOT and a clock signal to the source driver 1010 or 2010, and control an operation of the gate driver 2050.

The gate driver 2050 outputs gating signals to the display panel 2070 according to a control of the interface 2030 so that signals output from the output buffer circuit 2600 of the source driver 1010 or 2010 may be displayed through the display panel 2070.

The display panel 2070 may display signals output from the source driver 1010 or 2010 in response to gating signals output from the gate driver 2050. According to an exemplary embodiment, the source driver 1010 or 2010, the interface 2030 and the gate driver 2050 may be embodied in one chip or on separate, independent chips.

Figure 33:
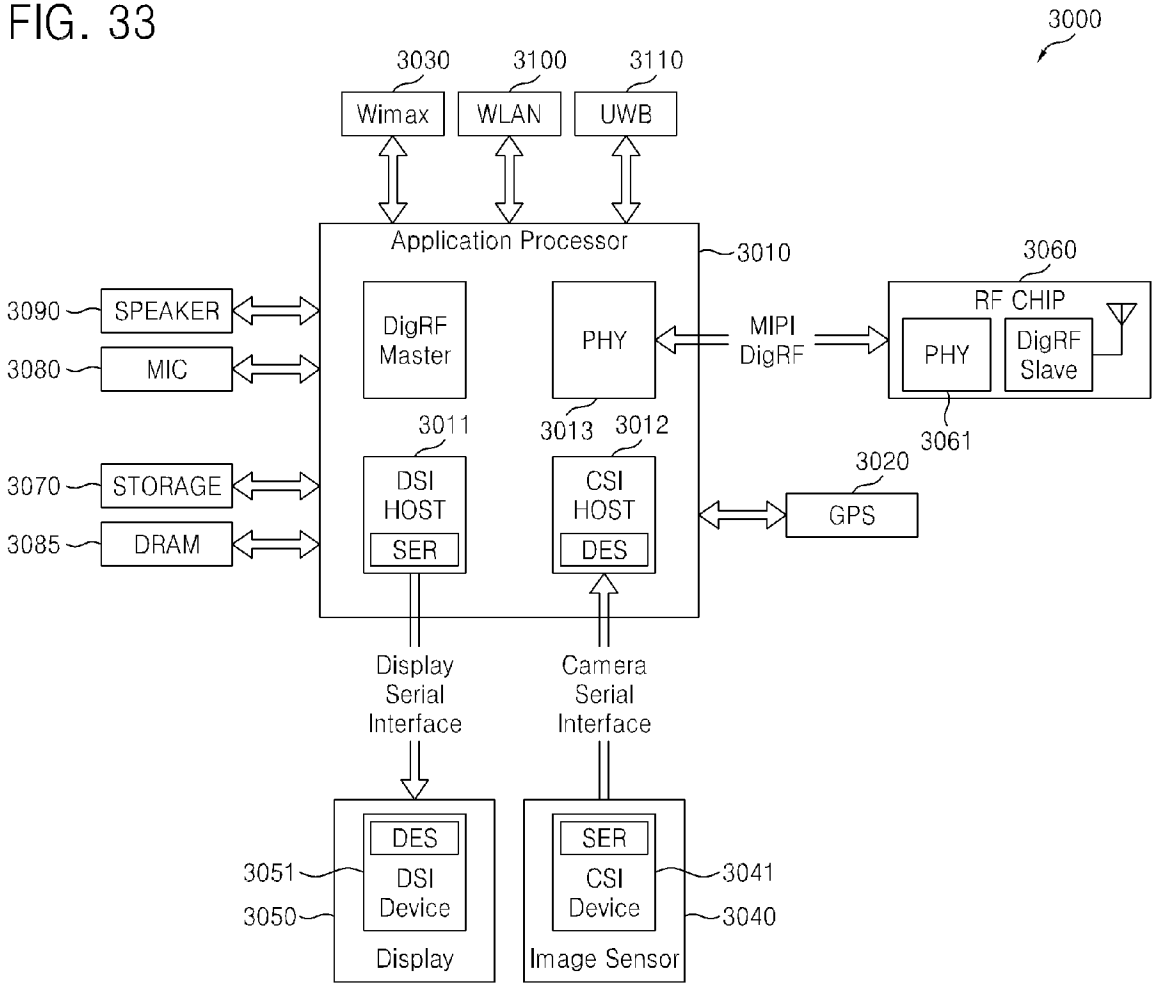
FIG. 33 is a schematic block diagram of an electronic system including the source driver illustrated in FIG. 1, 17 or 29 and an interface.

FIG. 33 is a schematic block diagram of an electronic system including the source driver illustrated in FIG. 1, 17 or 29 and an interface. Referring to FIGS. 1, 17, 29 and 33, an electronic system 3000 may be embodied in a data processing device which may use or support a MIPI interface, e.g., a cellular phone, a personal digital assistant (PDA), a portable multimedia player (PMP), a digital TV, an Internal Protocol Television (IPTV), a smart phone or a tablet personal computer (PC).

The electronic system 3000 includes an application processor 3010, an image sensor 3040 and a display 3050.

A CSI host 3012 embodied in the application processor 3010 may perform serial communication with a CSI device 3041 of the image sensor 3040 through a camera serial interface (CSI). The CSI host 3012 may include a de-serializer (DES), and the CSI device 3041 may include a serializer (SER).

A DSI host 3011 embodied in the application processor 3010 may perform serial communication with a DSI device 3051 of the display 3050 including the source driver 1010 of FIG. 1, the source driver 2010*a* of FIG. 17 or the source driver 2010*b* of FIG. 29 through a display serial interface (DSI). For example, the DSI host 3011 may include a serializer (SER), and the DSI 3051 may include a de-serializer (DES).

The electronic system 3000 may further include a RF chip 3060 which may communicate with the application processor 3010.

A PHY 3013 of the electronic system 3000 and a PHY 3061 of the RF chip 3060 may transmit or receive data to/from each other according to MIPI DigRF. The electronic system 3000 may further include a global positioning system (GPS) receiver 3020, a storage 3070, a microphone 3080, a DRAM 3085 and a speaker 3090.

The electronic system 3000 may perform radio communication with other devices by using World Interoperability for Microwave Access (Wimax), a transceiver 3030, a wireless local area network (WLAN) transceiver 3100, a ultra wideband (UWB) transceiver 3110 or a long term evolution (LTE™) transceiver.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include a semiconductor memory device, a read-only memory (ROM), a random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

A source driver according to an exemplary embodiment of the present general inventive concept and an operation method thereof may reduce the complexity of a circuit and the size of a chip by using non-overlapping latch control signals.

The source driver according to an exemplary embodiment of the present general inventive concept and the operation method thereof may mux data by using non-overlapping latch control signals or clock signals having different timings or phases. Here, storing and muxing (or dividing) the data are performed at the same time.

A source driver according to an exemplary embodiment of the present general inventive concept may reduce the number of data lines and increase the speed of data transmitted through the data line. The source driver of the present general inventive concept may reduce the number of multiplexers. The source driver according to an exemplary embodiment of the present general inventive concept and a display device having the same may embody a plurality of DOT inversion modes without additional multiplexers and reduce the complexity of a circuit and the size of a chip.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A source driver, comprising:

a latch control circuit configured to generate non-overlapping latch control signals successively in response to a selection signal, the latch control circuit including a plurality of multiplexers each configured to output one of a plurality of latch clock signals as one of the plurality of latch control signals in response to the selection signal;

a first latch circuit configured to arrange data blocks, which are input in series, in parallel in response to the non-overlapping latch control signals; and a second latch circuit configured to latch data blocks arranged in parallel simultaneously in response to a clock signal.

2. The source driver of claim 1, wherein each of the plurality of multiplexers alternately outputs the plurality of latch clock signals as the one of the plurality of latch control signals.

3. The source driver of claim 1, further comprising a control circuit configured to generate the selection signal based on a polarity control signal and an inversion mode control signal.

4. The source driver of claim 1, wherein the source driver includes:

a digital-to-analog conversion circuit configured to convert output signals of the second latch circuit into analog signals;

a multiplexing circuit configured to rearrange the analog signals in response to the selection signal; and an output buffer circuit configured to buffer and output the rearranged analog signals.

5. The source driver of claim 1, further comprising electrical connection to a display panel configured to display output signals of the source driver in response to a gating signal output from a gate driver.

6. A source driver, comprising:

a control circuit configured to generate a plurality of selection signals in response to a polarity control signal, which is a signal converted in every frame, and an inversion mode control signal that controls an inversion mode of a display;

a plurality of first type decoders;

a plurality of second type decoders each forming a symmetric pair with each of the plurality of first type decoders;

a plurality of multiplexers each configured to respectively output one of either output signals of the decoders forming the symmetric pairs in response to a corresponding one of the plurality of selection signals; and a plurality of buffers configured to buffer an output signal of a corresponding one of the plurality of multiplexers.

7. The source driver of claim 6, wherein the plurality of first type decoders are embodied in a first region and the plurality of second type decoders are embodied in a second region.

8. The source driver of claim 7, wherein the first region and the second region are electrically divided.

9. The source driver of claim 7, wherein the first region is an N-type well and the second region is a P-type well.

10. The source driver of claim 6, further comprising electrical connection to a display panel configured to display output signals of the plurality of buffers in response to a gating signal output from a gate driver.

* * * * *